US009086651B2

(12) United States Patent
Hosoya et al.

(10) Patent No.: US 9,086,651 B2
(45) Date of Patent: Jul. 21, 2015

(54) IMAGE FORMING APPARATUS

(75) Inventors: Shinji Hosoya, Naka-gun (JP); Toshikazu Tsuchiya, Susono (JP); Masafumi Monde, Yokohama (JP); Hidetoshi Hanamoto, Mishima (JP); Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 14/007,709

(22) PCT Filed: Apr. 4, 2012

(86) PCT No.: PCT/JP2012/059826

§ 371 (c)(1),
(2), (4) Date: Sep. 26, 2013

(87) PCT Pub. No.: WO2012/137972

PCT Pub. Date: Oct. 11, 2012

(65) Prior Publication Data

US 2014/0023385 A1 Jan. 23, 2014

(30) Foreign Application Priority Data

Apr. 6, 2011 (JP) ..... 2011-084508
Apr. 19, 2011 (JP) ..... 2011-093147

(51) Int. Cl.
*G03G 15/08* (2006.01)
*G03G 21/16* (2006.01)

(52) U.S. Cl.
CPC ..... *G03G 15/086* (2013.01); *G03G 15/0856* (2013.01); *G03G 15/0889* (2013.01); *G03G 21/1652* (2013.01); *G03G 2215/0888* (2013.01)

(58) Field of Classification Search
CPC ..... G03G 15/0831; G03G 15/0856; G03G 15/086; G03G 2215/0888
See application file for complete search history.

(56) References Cited

U.S. PATENT DOCUMENTS 4,592,642 A * 6/1986 Imaizumi et al. ..... 399/27
5,923,918 A * 7/1999 Nakagawa et al. ..... 399/27
(Continued)

FOREIGN PATENT DOCUMENTS

EP 1 055 975 A2 11/2000
JP 06-011935 A 1/1994
(Continued)

OTHER PUBLICATIONS

International Search Report and Written Opinion mailed Sep. 4, 2012, in International Application No. PCT/JP2012/059826.
(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

The image forming apparatus includes a developing unit that is detachable and contains a developer, a detection member that includes an electrode to be detected and is rotatable around a rotation axis in the developing unit, an agitator that moves around the rotation axis in the developing unit; an electrostatic capacitance sensor electrode provided on an exterior of the developing unit, an electrostatic capacitance sensor that detects electrostatic capacitance between the electrode to be detected and the electrostatic capacitance sensor electrode, and outputs data on the detected electrostatic capacitance, and a CPU that determines an amount of developer in the developing unit based on the data output from the electrostatic capacitance sensor.

17 Claims, 22 Drawing Sheets

(56) References Cited

U.S. PATENT DOCUMENTS

| | | | | |
|---|---|---|---|---|
| 6,041,196 | A * | 3/2000 | Nakagawa et al. | 399/27 |
| 6,208,816 | B1 | 3/2001 | Koizumi et al. | |
| 6,275,665 | B1 * | 8/2001 | Miyashiro | 399/27 |
| 6,654,569 | B2 * | 11/2003 | Nozawa | 399/27 |
| 7,421,216 | B2 | 9/2008 | Onda et al. | |
| 7,499,656 | B2 * | 3/2009 | Kimura et al. | 399/27 |
| 2013/0308965 | A1 | 11/2013 | Tsuchiya et al. | |
| 2014/0037305 | A1 | 2/2014 | Monde et al. | |
| 2014/0169806 | A1 * | 6/2014 | Leemhuis et al. | 399/27 |
| 2014/0212155 | A1 * | 7/2014 | Leemhuis et al. | 399/27 |
| 2014/0226994 | A1 * | 8/2014 | Leemhuis et al. | 399/13 |

FOREIGN PATENT DOCUMENTS

| | | | |
|---|---|---|---|
| JP | 07-055703 | A | 3/1995 |
| JP | 11-119537 | A | 4/1999 |
| JP | 11-184320 | A | 7/1999 |
| JP | 2000-75625 | A | 3/2000 |
| JP | 2002-132036 | A | 5/2002 |
| JP | 2003-248371 | A | 9/2003 |
| JP | 2004-354904 | A | 12/2004 |
| JP | 2008-139884 | A | 6/2008 |
| JP | 4137703 | B2 | 8/2008 |

OTHER PUBLICATIONS

Office Action in Japanese Patent Application No. 2011-084508, dated Dec. 24, 2014.

International Preliminary Report on Patentability mailed Oct. 17, 2013, in International Application No. PCT/JP2012/059826.

* cited by examiner

| TABLE T1 | |
|---|---|
| DETECTION LEVEL OF ELECTROSTATIC CAPACITANCE SENSOR | REMAINING AMOUNT OF TONER (%) |
| 135 | 100 |
| 137 | 90 |
| 138 | 80 |
| 144 | 70 |
| 155 | 60 |
| 172 | 50 |
| 188 | 40 |
| 213 | 30 |
| 237 | 20 |
| 249 | 10 |
| 253 | 0 |

FIG. 10A

| TABLE T1 (SENSITIVITY 69) | |
|---|---|
| DETECTION LEVEL OF ELECTROSTATIC CAPACITANCE SENSOR | REMAINING AMOUNT OF TONER (%) |
| 135 | 100 |
| 137 | 90 |
| 138 | 80 |
| 144 | 70 |
| 155 | 60 |
| 172 | 50 |
| 188 | 40 |
| 213 | 30 |
| 237 | 20 |
| 249 | 10 |
| 253 | 0 |

FIG. 10B

| TABLE T2 (SENSITIVITY 46) | |
|---|---|
| DETECTION LEVEL OF ELECTROSTATIC CAPACITANCE SENSOR | REMAINING AMOUNT OF TONER (%) |
| 133 | 50 |
| 135 | 45 |
| 139 | 40 |
| 147 | 35 |
| 160 | 30 |
| 178 | 25 |
| 197 | 20 |
| 221 | 15 |
| 240 | 10 |
| 248 | 5 |
| 252 | 0 |

FIG. 10C

| TABLE T3 (SENSITIVITY 92) | |
|---|---|
| DETECTION LEVEL OF ELECTROSTATIC CAPACITANCE SENSOR | REMAINING AMOUNT OF TONER (%) |
| 148 | 100 |
| 151 | 95 |
| 153 | 90 |
| 157 | 85 |
| 161 | 80 |
| 166 | 75 |
| 173 | 70 |
| 181 | 65 |
| 191 | 60 |
| 202 | 55 |
| 211 | 50 |

| TABLE T4 | |
|---|---|
| SENSITIVITY | REMAINING AMOUNT OF TONER (%) |
| 92 | 100 |
| 85 | 90 |
| 78 | 80 |
| 71 | 70 |
| 64 | 60 |
| 57 | 50 |
| 50 | 40 |
| 43 | 30 |
| 36 | 20 |
| 29 | 10 |
| 22 | 0 |

FIG. 17A
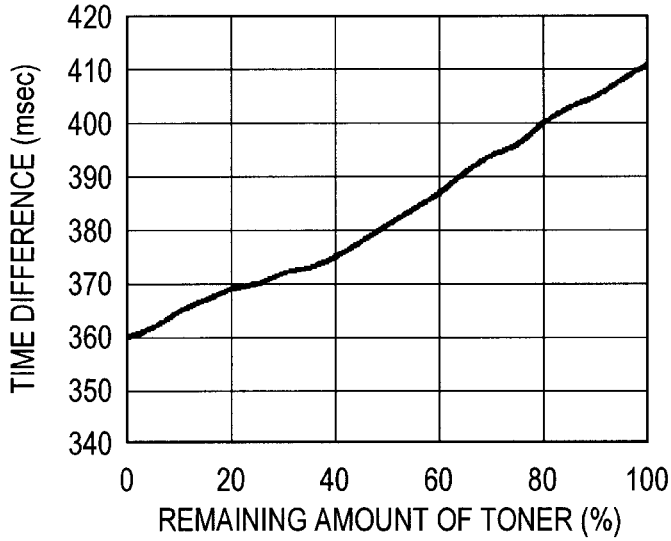
FIG. 17B
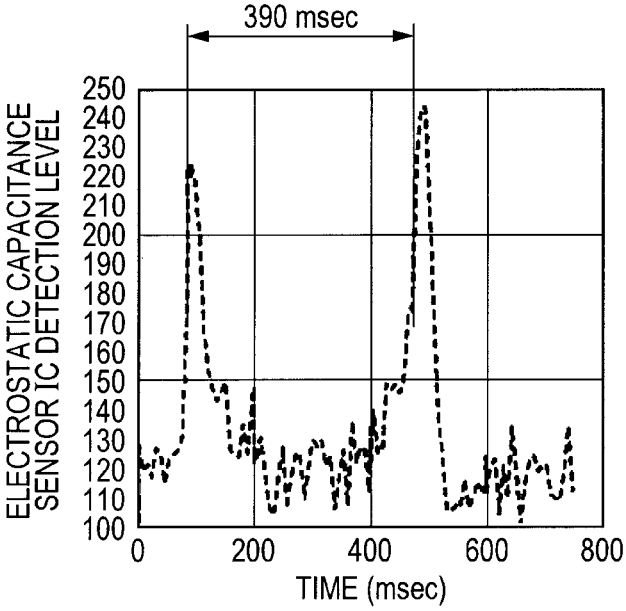
FIG. 17C
TABLE T
| TIME DIFFERENCE (msec) | REMAINING AMOUNT OF TONER (%) |
|---|---|
| 411 | 100 |
| 405 | 90 |
| 400 | 80 |
| 394 | 70 |
| 390 | 60 |
| 381 | 50 |
| 375 | 40 |
| 372 | 30 |
| 369 | 20 |
| 365 | 10 |
| 360 | 0 |

FIG. 20A
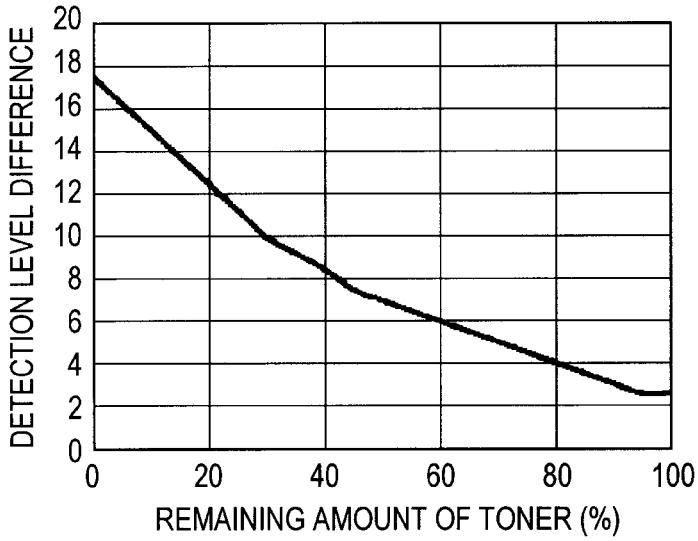
FIG. 20B
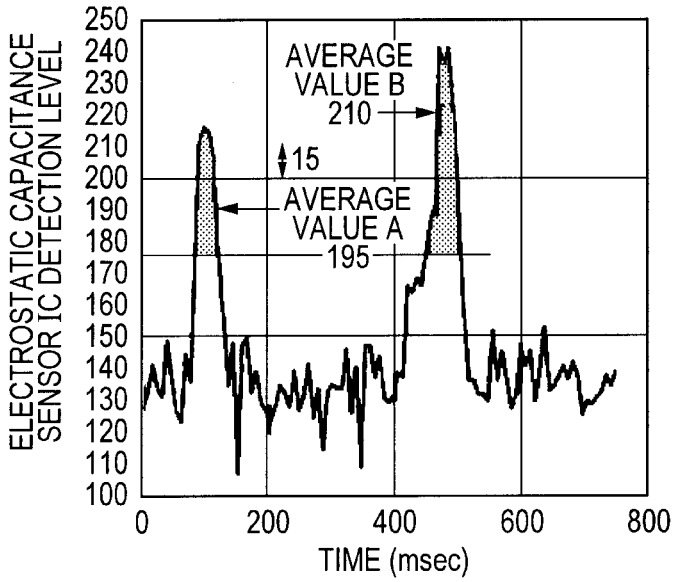
FIG. 20C
TABLE N
| DETECTION LEVEL DIFFERENCE | REMAINING AMOUNT OF TONER (%) |
|---|---|
| 2 | 100 |
| 3 | 90 |
| 4 | 80 |
| 5 | 70 |
| 6 | 60 |
| 7 | 50 |
| 8.5 | 40 |
| 10 | 30 |
| 12.5 | 20 |
| 15 | 10 |
| 17.5 | 0 |

IMAGE FORMING APPARATUS

TECHNICAL FIELD

The present invention relates to detection of a remaining amount of toner as a developer in an electrophotographic image forming apparatus such as a laser printer, a copier, or a facsimile.

BACKGROUND ART

In an example of a conventional image forming apparatus, an electrostatic capacitance detection apparatus detects a remaining amount of toner in a toner container. For example, in an apparatus for detecting a remaining amount of toner described in PTL 1, a flexible member is fixedly connected to one end of an agitation member for agitating a toner in a toner container, a member to be detected is secured to a tip of the flexible member, and an electrostatic capacitance detection apparatus is placed in a lower part of the toner container. The flexible member connected to the agitation member is rotated with rotation of the agitation member and enters the toner. If a toner surface in the toner container is higher than a connecting position between the flexible member and the agitation member, the flexible member enters the toner at a connecting portion to the agitation member, the entire flexible member is flexibly deformed, and rotated along the same trajectory as the connecting portion in the toner. Thus, the member to be detected at the tip of the flexible member is rotated along the same trajectory as the flexible member. However, if an amount of toner is reduced, and the toner surface is lower than the connecting position between the flexible member and the agitation member, and the connecting portion of the agitation member does not enter the toner, the tip and therearound of the flexible member slides on the toner surface, and the member to be detected also slides on the toner surface. With decreasing remaining amount of toner, a height of the toner surface in the toner container is gradually reduced, and a position of the member to be detected sliding on the toner surface is also lowered. Specifically, when the amount of toner is reduced to less than a certain amount, the position of the member to be detected moving on the toner surface is lowered according to the remaining amount of toner, and brought close to a bottom surface of the toner container.

Meanwhile, the electrostatic capacitance detection apparatus can detect electrostatic capacitance between the electrostatic capacitance detection apparatus and the member to be detected moving on the toner surface. The electrostatic capacitance between the electrostatic capacitance detection apparatus and the member to be detected changes depending on a distance therebetween. The electrostatic capacitance detection apparatus is placed in the lower part of the toner container, and with decreasing amount of toner, the height of the toner surface is gradually reduced, and the position of the member to be detected on the toner surface is also lowered. This reduces the distance between the electrostatic capacitance detection apparatus and the member to be detected to reduce the electrostatic capacitance therebetween. Specifically, the electrostatic capacitance between the electrostatic capacitance detection apparatus and the member to be detected changes depending on the remaining amount of toner.

An example of an apparatus for detecting an amount of toner in a developing unit uses a magnetic permeability sensor. For example, PTL 1 is an example of an apparatus for detecting an amount of toner using a magnetic permeability sensor. PTL 2 discloses a toner amount detection apparatus using a first agitation blade that is flexible and may be deformed rearward in a rotational direction by agitation of toner, a second agitation blade that is rigid and placed on a rear side in the rotational direction of the first agitation blade, and a magnetic permeability sensor placed on an outer side of a bottom of a developing unit. The apparatus detects a state of rotation of a metal material placed on each agitation blade using the magnetic permeability sensor placed on the outer side of the bottom of the developing unit. This apparatus is configured so that in the case with a large amount of toner in the developing unit, the first agitation blade and the second agitation blade are integrally rotated, and in the case with a small amount of toner in the developing unit, the first agitation blade and the second agitation blade are separately rotated without being deformed. At this time, the magnetic permeability sensor is used to detect once a change in the magnetic permeability for one turn of the rotation axis in the case with a large amount of toner in the developing unit, and twice in the case with a small amount of toner in the developing unit. The toner amount detection apparatus detects the amount of toner in the developing unit based on the change in the number of times of detection.

CITATION LIST

Patent Literature

PTL 1: Japanese Patent No. 4,137,703

PTL 2: Japanese Patent Application Laid-Open No. 2002-132036

SUMMARY OF INVENTION

Technical Problem

However, the configuration of the conventional apparatus for detecting a remaining amount of toner has problems described below. As described in PTL 1, in the case with a certain amount or more of toner, the connecting portion between the flexible member and the agitation member enters the toner, and the trajectories drawn by the flexible member and the member to be detected are substantially the same. Thus, in the case with a certain amount or more of toner, the distance between the electrostatic capacitance detection apparatus and the member to be detected hardly changes, thus the detected electrostatic capacitance hardly changes, and a remaining amount of toner cannot be sequentially accurately detected.

PTL 1 has problems described below. In the case with a large amount of toner, the first and second agitation blades are integrally rotated, and thus a signal detected by the magnetic permeability sensor indicates one change in the magnetic permeability for one turn of the rotation axis. Meanwhile, in the case with a small amount of toner, the first agitation blade is hardly deformed, and the first and second agitation blades are not integrally rotated. At this time, a signal detected by the magnetic permeability sensor indicates two changes in magnetic permeability for one turn of the rotation axis. Thus, whether the amount of toner is large or small or whether there is a toner or not is alternatively detected by the number of (one or two) magnetic field changes detected by the magnetic permeability sensor. Thus, it is difficult to successively detect the change in the amount of toner.

The present invention is achieved under such circumstances, and has an object to successively detect a remaining amount with high accuracy irrespective of an amount of toner with a simple configuration.

Solution to Problem

Advantageous Effects of Invention

According to the present invention, a remaining amount can be successively detected with high accuracy irrespective of an amount of toner with a simple configuration.

BRIEF DESCRIPTION OF DRAWINGS

FIGS. 10A, 10B and 10C are characteristic tables according to the sensor sensitivity in Embodiment 2.

FIGS. 17A, 17B and 17C respectively show a characteristic graph, a waveform, and a table T of detection of a remaining amount of toner in Embodiments 4 and 5.

FIGS. 20A, 20B and 20C respectively show a characteristic graph, a waveform, and a table N of detection of a remaining amount of toner in Embodiments 6 and 7.

DESCRIPTION OF EMBODIMENTS

Now, embodiments of the present invention will be described in detail.

Embodiment 1

(Outline of Image Forming Apparatus)

Figure 1:
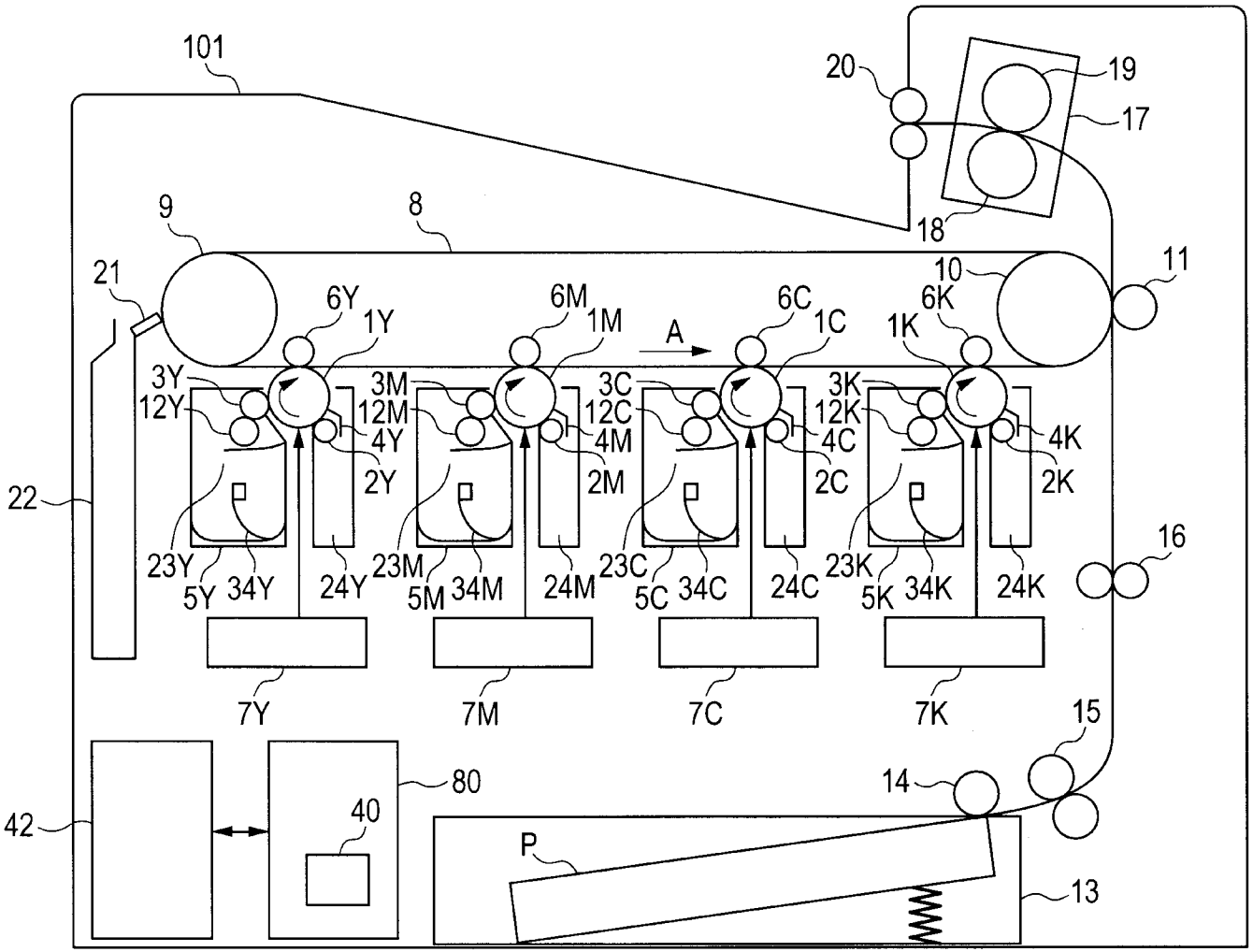
FIG. 1 is a sectional view illustrating an entire configuration of an image forming apparatus in Embodiments 1 to 3.

FIG. 1 is a sectional view illustrating an entire configuration of a color laser printer as an example of an image forming apparatus of this embodiment. With reference to FIG. 1, a configuration and a basic operation of the color laser printer will be described. The color laser printer (hereinafter referred to as a main body) illustrated in FIG. 1 includes process cartridges 5Y, 5M, 5C and 5K detachable from a main body 101. The four process cartridges 5Y, 5M, 5C and 5K have the same structure, but form images using toners (developers) of different colors, that is, yellow (Y), magenta (M), cyan (C), and black (K). Hereinafter, Y, M, C and K are sometimes omitted. The process cartridge 5 includes three units: a developing unit, an image forming unit, and a waste toner unit. The developing unit includes a developing roller 3, a toner supply roller 12, a toner container 23, and an agitator 34. The image forming unit includes a photosensitive drum 1 as an image bearing member, and a charging roller 2. The waste toner unit includes a cleaning blade 4, and a waste toner container 24.

A laser unit 7 is placed below the process cartridge 5, and the laser unit 7 performs exposure on a photosensitive drum 1 based on image signals. The photosensitive drum 1 is charged to a potential of a predetermined negative polarity by the charging roller 2, and an electrostatic latent image is formed by the laser unit 7. The electrostatic latent image is reversely developed by the developing roller 3, and a toner of negative polarity is attached to the image. On the photosensitive drums 1, Y, M, C and K toner images are formed respectively. An intermediate transfer belt unit includes an intermediate transfer belt 8, a driving roller 9, and a secondary transfer counter roller 10. Inside the intermediate transfer belt 8, a primary transfer roller 6 is provided to face each photosensitive drum 1, and a voltage applying unit (not shown) applies a transfer bias (transfer voltage) to the primary transfer roller 6.

A toner image formed on the photosensitive drum 1 is rotated in an arrow direction of the photosensitive drum 1, and the intermediate transfer belt 8 is rotated in an arrow A direction. Further, the voltage applying unit (not shown) applies a bias of positive polarity to the primary transfer roller 6, and thus toner images on the photosensitive drums 1 are primarily transferred onto the intermediate transfer belt 8 in order of Y, M, C and K, and conveyed to a secondary transfer roller 11 with the toner images of the four colors being overlapped. A feeding and conveying apparatus includes a paper feed roller 14 that feeds a transfer material P from a paper feed cassette 13 housing the transfer material P, and a pair of conveying rollers 15 that convey the fed transfer material P. The transfer material P conveyed by the feeding and conveying apparatus is conveyed to the secondary transfer roller 11 by the pair of registration rollers 16.

For transfer of the toner image from the intermediate transfer belt 8 to the transfer material P, a bias of positive polarity is applied to the secondary transfer roller 11, and thus the toner image on the intermediate transfer belt 8 is secondarily transferred to the conveyed transfer material P. The transfer material P to which the toner image is transferred is conveyed to a fixing apparatus 17, heated and pressurized by a fixing film 18 and a pressure roller 19, and discharged by a pair of paper discharge rollers 20 with the toner image being fixed on a surface of the transfer material P. Then, after the transfer to the intermediate transfer belt 8, a toner remaining on the surface of the photosensitive drum 1 is removed by the cleaning blade 4, and the removed toner is collected in the waste toner container 24. After the secondary transfer to the transfer material P, the toner remaining on the intermediate transfer belt 8 is removed by a transfer belt cleaning blade 21, and the removed toner is collected in a waste toner container 22.

A one-chip microcomputer (hereinafter referred to as CPU) 40 for controlling the main body, and a storage section such as a RAM or a ROM that stores data in a table are mounted on a control board 80. The CPU 40 collectively controls operations of the main body such as control of a drive source (not shown) relating to conveyance of the transfer material P, control of a drive source (not shown) of the process cartridge 5, control relating to image forming, and control relating to failure detection. Further, the CPU 40 includes a timer therein. The ROM of the storage section stores programs or various types of data for controlling an image forming operation of the image forming apparatus. The RAM of the storage section is used for calculation of data required for controlling the image forming operation of the image forming apparatus or temporary storing. The timer is used for measuring time. A video controller 42 controls emission of a laser in the laser unit based on image data. The video controller 42 also interfaces with a user via a control panel (not shown), and the control panel displays a remaining amount of toner of each color in a bar graph.

(Configuration of Developing Unit and Electrostatic Capacitance Sensor)

Figure 2:
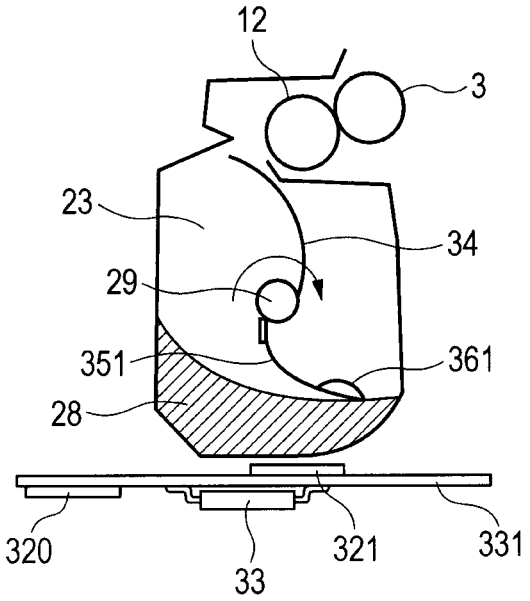
FIG. 2 is a sectional view of a developing unit and an electrostatic capacitance sensor in Embodiments 1 to 3.

FIG. 2 is a sectional view of a developing unit that constitutes the process cartridge 5, and an electrostatic capacitance sensor provided on a bottom surface of the developing unit. The developing unit in the process cartridge 5 in FIG. 2 includes the developing roller 3, and the toner supply roller 12. Further, the toner container 23 contains a toner 28 corresponding to each color, and an agitator 34 that agitates the toner 28. The agitator 34 (second member) is configured so that an agitation element is rotatable around a rotation axis 29 in the toner container 23, and the agitation element is moved around the rotation axis 29 rotated by an unshown motor. As the agitation element, for example, a general-purpose polyester film can be used. A flexible detection member 351 (first member) for detecting a remaining amount of toner 28 is provided on the rotation axis 29, and is rotatable around the rotation axis 29. Further, the detection member 351 includes a conductive electrode to be detected 361 (first electrode) near a tip in a circumferential direction.

An electrostatic capacitance sensor board 331 provided near a bottom surface of the process cartridge 5 in FIG. 2 is provided in the main body 101, and an electrostatic capacitance sensor 33 and a peripheral circuit component (not shown) of the electrostatic capacitance sensor 33 are mounted on the electrostatic capacitance sensor board 331. The electrostatic capacitance sensor 33 detects a change in the electrostatic capacitance of an electrostatic capacitance sensor electrode 321 using a difference between electrostatic capacitance of the electrostatic capacitance sensor electrode 321 and electrostatic capacitance of a reference electrode 320. The electrostatic capacitance sensor electrode 321 and the reference electrode 320 are provided in a copper foil pattern on the electrostatic capacitance sensor board 331. A bottom surface of an exterior of the developing unit is brought close to the electrostatic capacitance sensor electrode 321 (second electrode) when the process cartridge 5 is mounted to the main body 101. In this state, the electrostatic capacitance sensor 33 detects electrostatic capacitance generated by the electrode to be detected 361 provided on the detection member 351 being brought close to the electrostatic capacitance sensor electrode 321.

Figure 3A:
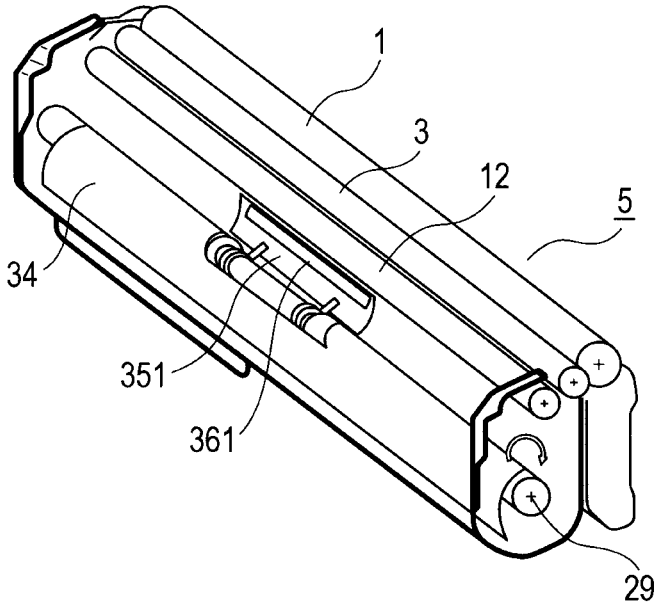
FIG. 3A is a perspective view of the developing unit.

FIG. 3A is a perspective view of the process cartridge 5. The detection member 351 is rotatable around the rotation axis 29. Thus, in the case where the agitator 34 is rotated in a direction opposite to gravity (ascending direction), the detection member 351 is rotated with the agitator 34 while being lifted by the agitator 34 together with the toner 28. On the other hand, in the case where the agitator 34 is rotated in a gravity direction (descending direction), the detection member 351 freely falls in the gravity direction by its own weight after fall of the toner 28 and before fall of the agitator 34. The detection member 351 may be configured so as to fall on the toner 28 after fall of the toner 28 agitated by the agitator 34, and is not limited to the configuration in FIG. 3A.

The electrostatic capacitance sensor 33 and the peripheral circuit may be those that can detect electrostatic capacitance, and an analog integrated circuit may be used. In this embodiment, the electrostatic capacitance sensor electrode 321 is formed on the electrostatic capacitance sensor board 331 provided in the main body 101, but may be provided near the bottom surface of the developing unit. For example, the electrostatic capacitance sensor electrode 321 may be directly formed on the bottom surface of the developing unit. In this case, electrical contacts may be provided on the electrostatic capacitance sensor board 331 and the electrostatic capacitance sensor electrode 321, and the electrostatic capacitance sensor board 331 and the electrostatic capacitance sensor electrode 321 may be connected when the process cartridge 5 is mounted to the main body 101.

(Circuit Configuration of Electrostatic Capacitance Sensor)

Figure 3B:
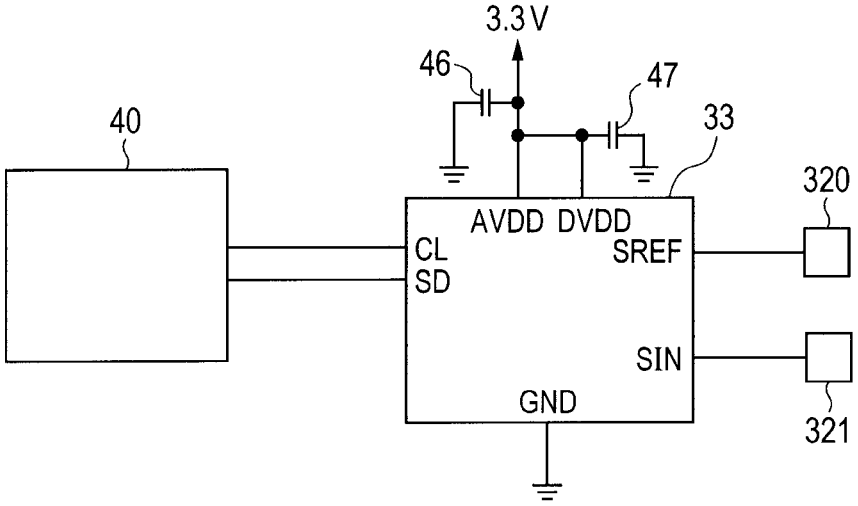
FIG. 3B is a view illustrating a circuit configuration of the electrostatic capacitance sensor and therearound in Embodiments 1 to 3.

FIG. 3B illustrates a connection between the electrostatic capacitance sensor 33, the CPU 40, the reference electrode 320, and the electrostatic capacitance sensor electrode 321. In FIG. 3B, AVDD denotes an analogue power supply terminal of the electrostatic capacitance sensor 33, and DVDD denotes a digital power supply terminal, and bypass capacitors 46 and 47 are provided to remove noise of the power supply terminals. The reference electrode 320 is connected to an SREF terminal, and the electrostatic capacitance sensor electrode 321 is connected to an SIN terminal. Data is transmitted and received by serial communication between the CPU 40 and the electrostatic capacitance sensor 33. From the CPU 40, a clock signal for synchronizing communication is supplied to a CL terminal of the electrostatic capacitance sensor 33. From the electrostatic capacitance sensor 33, 8-bit detection data corresponding to a detected electrostatic capacitance value is output through an SD terminal to the CPU 40. On the other hand, setting data for controlling the electrostatic capacitance sensor 33 is input from the CPU 40 through the SD terminal to the electrostatic capacitance sensor 33.

As described above, the electrostatic capacitance sensor 33 detects a difference between the electrostatic capacitance between the electrode to be detected 361 and the electrostatic capacitance sensor electrode 321 and the electrostatic capacitance of the reference electrode 320 to detect a change in the electrostatic capacitance of the electrostatic capacitance sensor electrode 321. The electrostatic capacitance sensor 33 includes therein an amplification circuit that amplifies the detected difference in electrostatic capacitance. The CPU 40 can set sensitivity of the electrostatic capacitance sensor 33 indicating an amplification factor of the amplification circuit through serial communication to the electrostatic capacitance sensor, and can set 92 stages of 1 to 92. When the sensitivity of the electrostatic capacitance sensor 33 is set to a high value, 92, a more minute change in the electrostatic capacitance can be captured. Thus, even if the electrode to be detected 361 is far from the electrostatic capacitance sensor electrode 321, the electrostatic capacitance can be detected. On the other hand, when the sensitivity of the electrostatic capacitance sensor 33 is set to a low value, 1, a change in the electrostatic capacitance cannot be captured if the change is small. Thus, if the electrode to be detected 361 is far from the electrostatic capacitance sensor electrode 321, the change in the electrostatic capacitance cannot be detected. The electrostatic capacitance sensor 33 in this embodiment includes a circuit for adjusting the sensitivity. The electrostatic capacitance sensor may have a configuration that can change the sensitivity in detection of the electrostatic capacitance between the electrostatic capacitance sensor electrode 321 and the electrode to be detected 361, and is not limited to the electrostatic capacitance sensor used in this embodiment.

(Operations of Agitator and Detection Member)

Figure 4A:
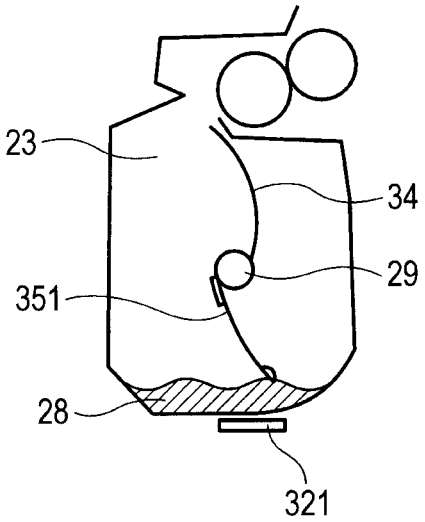
FIGS. 4A, 4B and 4C illustrate operations of an agitator of the developing unit and a detection member in Embodiments 1 to 3.
Figure 4B:
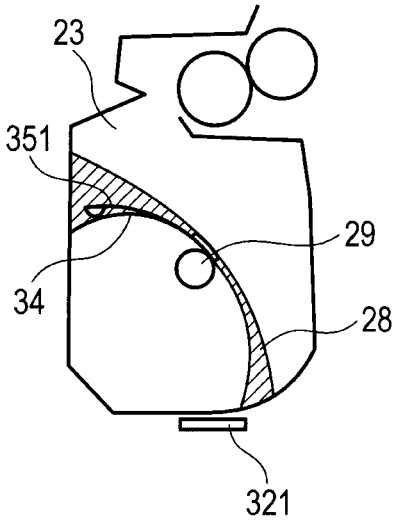
Figure 4C:
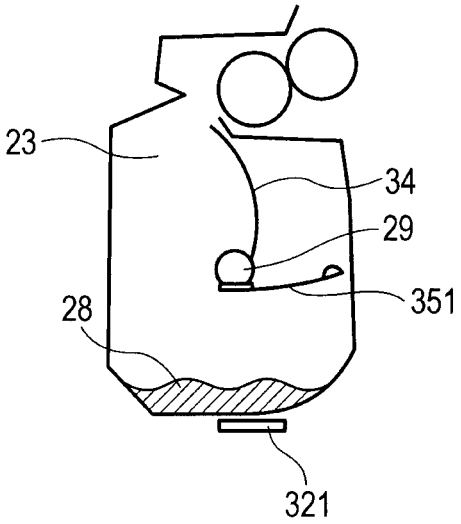

FIGS. 4A, 4B and 4C illustrate operations of the agitator 34 and the detection member 351 that detect a remaining amount of toner 28 in the toner container 23. FIG. 4A illustrates an initial state of rotation in which a tip of the agitator 34 is located at the highest point, and the detection member 351 is rotatable around the rotation axis 29 and thus freely falls by its own weight and rests on the toner 28. FIG. 4B illustrates the agitator 34 being rotated together with the detection member 351. The rotation axis 29 is rotated from the state in FIG. 4A, and thus the agitator 34 is rotated to abut against the detection member 351 resting on the toner 28. The agitator 34 is rotated upward with the detection member 351, and the toner 28 is also pushed up by the detection member. The toner 28 has fluidity, and thus starts falling by its own weight from the agitator 34 to the bottom surface of the toner container 23 before the agitator 34 reaches the highest point, and is accumulated on the bottom surface of the toner container 23. FIG. 4C illustrates the agitator 34 reaching the highest point. When the agitator 34 together with the detection member 351 reaches the highest point, and further the rotation axis 29 is rotated, the detection member 351 is separated from the agitator 34 because of being rotatable around the rotation axis 29, and starts moving down (free fall) by its own weight to the surface of the accumulated toner 28. On the other hand, the agitator 34 is connected to the rotation axis 29, and thus follows the detection member 351 and gradually moves down with the rotation of the rotation axis 29.

Figure 5A:
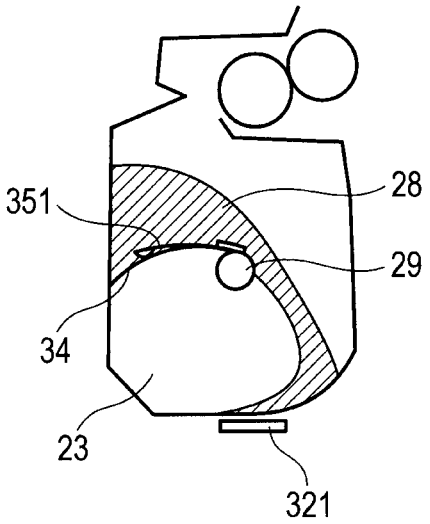
FIGS. 5A, 5B, 5C and 5D illustrate operations of the detection member in the case with a large amount of toner and the case with a small amount of toner in Embodiment 1 to 3.
Figure 5B:
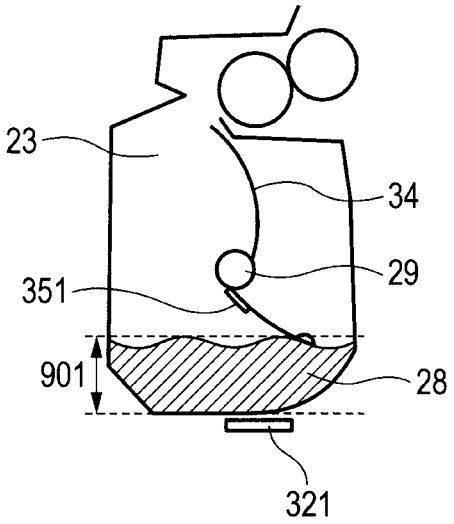

FIGS. 5A to 5D illustrate states of the detection member 351 in the case with a large remaining amount of toner 28 and the case with a small remaining amount of toner 28. FIGS. 5A and 5B illustrate operation states of the detection member 351 when the remaining amount of toner 28 is relatively large, FIG. 5A corresponds to the state in FIG. 4B, and FIG. 5B corresponds to the state in FIG. 4A. In the state in FIG. 5A, the agitator 34 abuts against the detection member 351 and pushes up the toner 28 with rotation of the rotation axis 29. The toner 28 has fluidity, and thus starts falling by its own weight from the agitator 34 to the bottom surface of the toner container 23 before the agitator 34 reaches the highest point, and is accumulated on the bottom surface of the toner container 23. Then, when the rotation axis 29 is rotated and the agitator 34 reaches the highest point, the detection member 351 starts moving down by its own weight because of being rotatable around the rotation axis 29. The detection member 351 falls after the toner 28 is accumulated on the bottom surface of the toner container 23, and stops on the surface of the toner 28. FIG. 5B illustrates the state of the detection member 351 at that time. In the case with a large remaining amount of toner 28, a height from the bottom surface of the toner container 23 to the surface of the toner 28 is large, and a stop position of the detection member 351 is at a height 901.

Figure 5C:
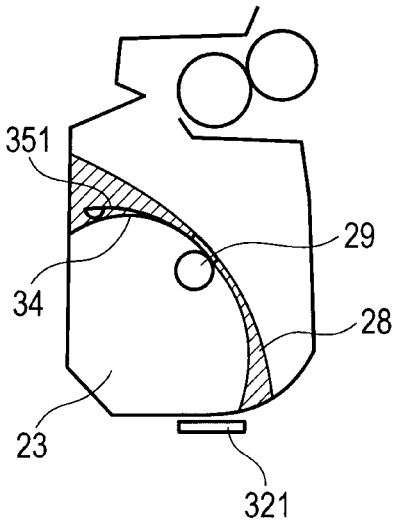
Figure 5D:
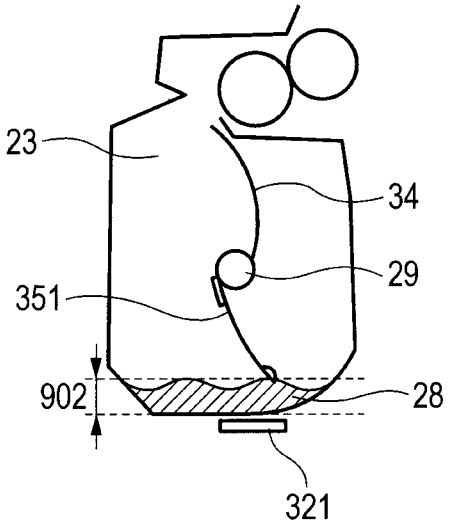

FIGS. 5C and 5D illustrate operation states of the detection member 351 in the case with a relatively small remaining amount of toner 28. FIG. 5C corresponds to the state in FIG. 4B, and FIG. 5D corresponds to the state in FIG. 4A. In the state in FIG. 5C, as described above, the agitator 34 abuts against the detection member 351 and pushes up the toner 28 with rotation of the rotation axis 29. In the case with a small remaining amount of toner 28, the toner starts falling from the agitator 34 to the bottom surface of the toner container 23 at later timing, that is, with the tip of the agitator 34 being at a higher position than that in the case with a large remaining amount of toner, and is accumulated on the bottom surface of the toner container 23. Then, when the rotation axis 29 is rotated, and the agitator 34 reaches the highest point, the detection member 351 starts falling by its own weight because of being rotatable around the rotation axis 29. The detection member 351 falls after the toner 28 is accumulated on the bottom surface of the toner container 23, and stops on the surface of the toner 28. FIG. 5D illustrates the state of the detection member 351 at that time. In the case with a small remaining amount of toner 28, the height from the bottom surface of the toner container 23 to the surface of the toner 28 is small, and a stop position of the detection member 351 is at a height 902.

The height of the surface of the toner 28 accumulated on the bottom surface of the toner container 23 changes according to the remaining amount of toner 28 in the toner container 23, thus the detection member 351 falls by its own weight, and there is a difference in height of the stop position. This causes a difference in electrostatic capacitance between the electrode to be detected 361 provided on the detection member 351 and the electrostatic capacitance sensor electrode 321. The electrostatic capacitance sensor 33 detects the difference in the electrostatic capacitance, the CPU 40 can detect a distance between the detection member 351 and the electrostatic capacitance sensor electrode 321 by a detection level from the electrostatic capacitance sensor 33, thereby allowing the remaining amount of toner 28 to be calculated.

(Detection Characteristic of Detection of Remaining Amount of Toner)

Next, with reference to FIGS. 6A and 6B, a detection characteristic of the remaining amount of toner in this embodiment will be described. In this embodiment, a detection level of the electrostatic capacitance sensor 33 is output as 8-bit data to the CPU 40. In the description below, the detection level is decimally expressed.

Figures 6A, 6B:
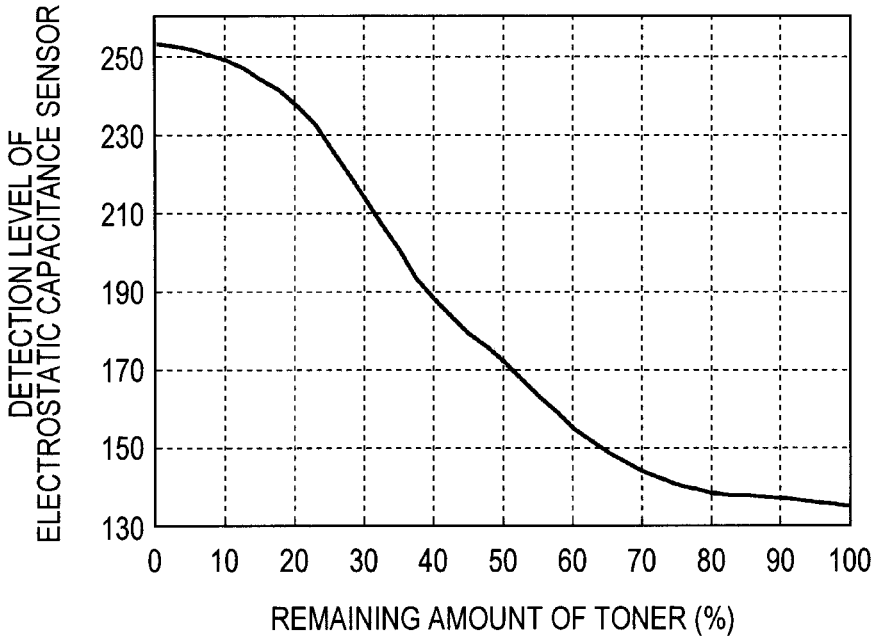
FIG. 6A is a characteristic graph and FIG. 6B is a table T1 in Embodiment 1.

FIG. 6A is a characteristic graph illustrating a relationship between the remaining amount of toner 28 in the toner container 23 and the detection level of the electrostatic capacitance sensor 33, the ordinate represents the detection level, and the abscissa represents the remaining amount of toner (%). The CPU 40 sets the sensitivity of the electrostatic capacitance sensor 33 in FIG. 6A to 69 by serial communication. As illustrated in the characteristic graph in FIG. 6A, in this embodiment, when the remaining amount of toner 28 in the toner container 23 is 100%, the detection level of the electrostatic capacitance sensor 33 is 135. Meanwhile, when the remaining amount of toner 28 is 0%, the detection level of the electrostatic capacitance sensor 33 is 253.

FIG. 6B is a table T1 illustrating correspondence between the detection level of the electrostatic capacitance sensor 33 and the remaining amount of toner (%) from the characteristic graph in FIG. 6A. The remaining amount of toner 28 corresponding to a detection level that is not specified in the table T1 can be calculated by a linear interpolation of the known remaining amount of toner 28 described in the table T1. Since the measured detection level is a value in this embodiment, the measured detection level changes depending on measurement conditions. The same applies to values in the table T1 for determining the remaining amount of toner 28. Information in the table T1 is previously written on the ROM of the storage section or an ROM provided in the process cartridge 5 in a factory and shipped. The information in the table T1 written on the ROM provided in the cartridge 5 is read by the CPU 40 when the process cartridge 5 is mounted to the main body 101, and stored in the RAM of the storage section on the control board 80. Also in Embodiments 2 and 3 described later, the table information is recorded in the ROM or the RAM of the storage section by such a method. The method of recording the table information in shipment described above is an example, and not limited to this.

(Process Sequence of Detection of Remaining Amount of Toner)

Figure 7:
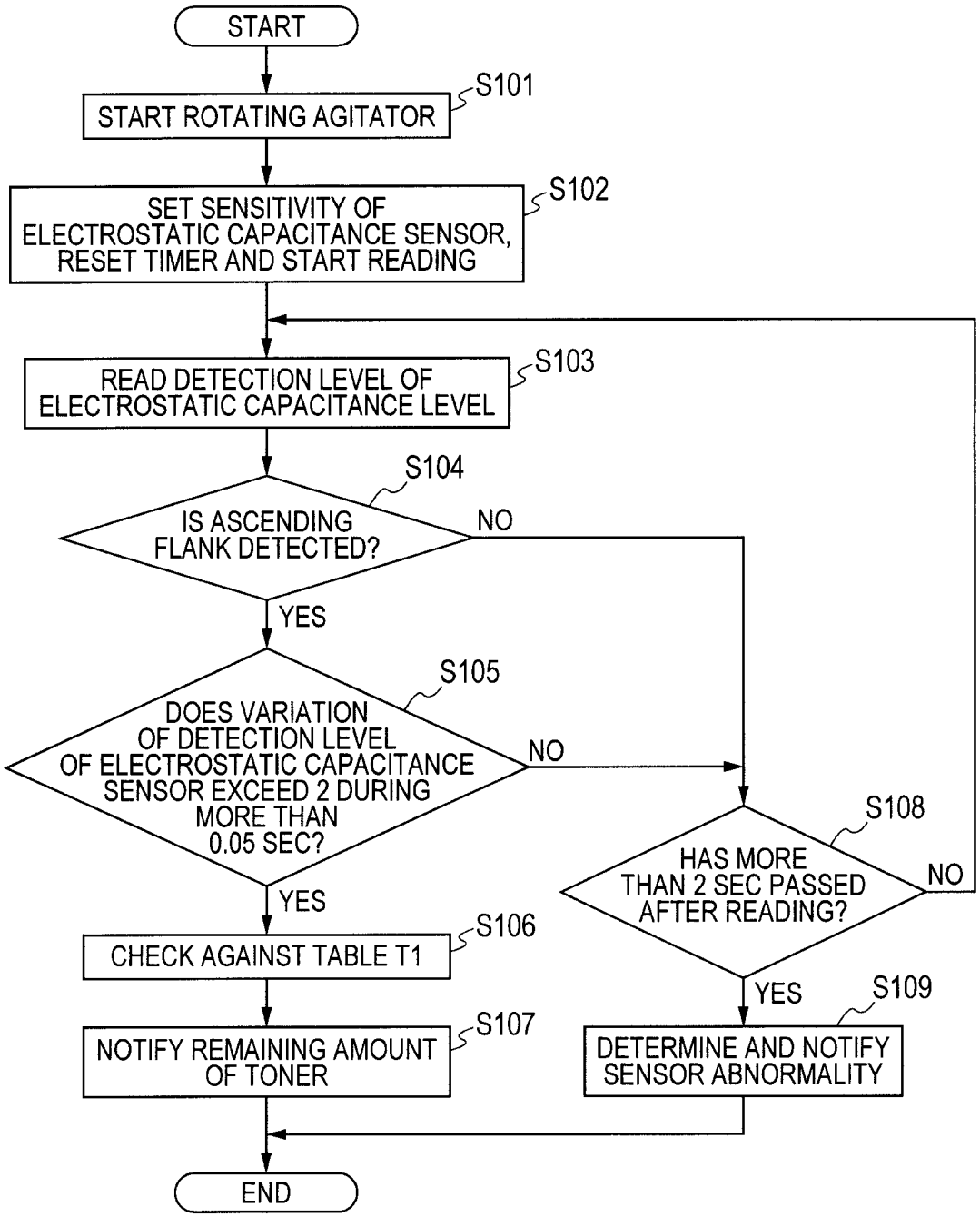
FIG. 7 is a flowchart illustrating a process sequence of detection of a remaining amount of toner in Embodiment 1.

Next, with reference to a flowchart in FIG. 7, a process sequence of detection of the remaining amount of toner in this embodiment will be described. The processes in FIG. 7 are performed by the CPU 40 based on a control program stored in the ROM of the storage section, and processes in flowcharts in embodiments described later are also performed by the CPU 40. It may be allowed that all the processes in the flowchart are not performed by the CPU 40, but, for example, in the case where an integrated circuit (ASIC) for characteristic use is mounted in the image forming apparatus, the ASIC has a function of performing any of the processes in the flowchart.

In Step 101 (hereinafter referred to as S101), the CPU 40 rotates the agitator 34. In this embodiment, it takes about 1 second for the agitator 34 to rotate one turn. In S102, the CPU 40 performs serial communication with the electrostatic capacitance sensor 33, and sets the sensitivity of the electrostatic capacitance sensor to 69. The CPU 40 resets and starts the timer, and starts reading the detection level by the electrostatic capacitance sensor 33.

Figure 8:
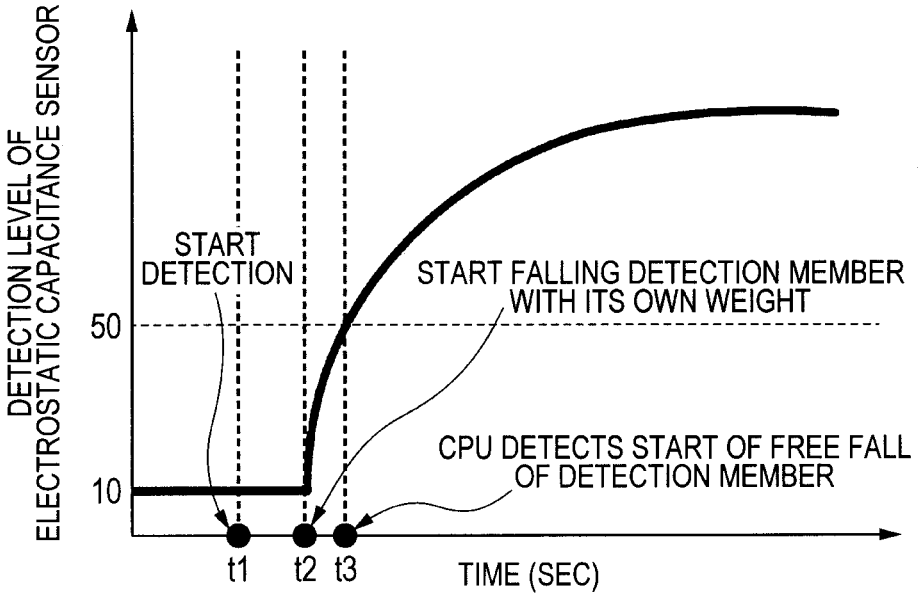
FIG. 8 is a graph illustrating changes in detection level of the electrostatic capacitance sensor by free fall of the detection member in Embodiment 1.

In S103, the CPU 40 receives reading data of the detection level from the electrostatic capacitance sensor 33 by serial communication. In S104, the CPU 40 determines whether the detection member 351 starts free fall by its own weight, from the detection level according to the electrostatic capacitance between the electrode to be detected 361 provided on the detection member 351 and the electrostatic capacitance sensor electrode 321. With reference to FIG. 8, changes in detection level of the electrostatic capacitance sensor 33 by free fall of the detection member 351 by its own weight will be described. FIG. 8 is a graph illustrating transition of the detection level of the electrostatic capacitance sensor 33 with time by free fall of the detection member 351, the ordinate represents the detection level of the electrostatic capacitance sensor, and the abscissa represents time (seconds). In FIG. 8, t1 denotes timing when the agitator 34 is rotated to start detection operation by the electrostatic capacitance sensor 33, and t2 denotes timing when the detection member 351 lifted to the highest point by the agitator 34 starts free fall by its own weight. Until t2, the electrode to be detected 361 provided on the detection member 351 is away from the electrostatic capacitance sensor electrode 321, and the detection level output from the electrostatic capacitance sensor 33 to the CPU 40 indicates a low level (10 or less). However, when the detection member 351 starts free fall, the distance between the electrode to be detected 361 and the electrostatic capacitance sensor electrode 321 is rapidly reduced, and thus the detection level output from the electrostatic capacitance sensor 33 to the CPU 40 also increases. When the detection member 351 falls on the toner 28 and stops, the distance between the electrode to be detected 361 and the electrostatic capacitance sensor electrode 321 is constant, and the detection level of the electrostatic capacitance sensor 33 is also stable at a constant value. In this embodiment, as indicated by t3 in FIG. 8, the CPU 40 sets an ascending flank threshold value of the detection level indicating that the detection member 351 starts free fall to 50. When timing (t3) of exceeding the ascending flank threshold value from the low level (10 or less) is detected, the CPU 40 detects that the detection member 351 starts free fall by its own weight.

When the CPU 40 determines in S104 that the electrostatic capacitance between the electrode to be detected 361 and the electrostatic capacitance sensor electrode 321 is not a certain value or more, and the ascending flank of the detection level is not detected, the CPU 40 proceeds to S108. When the CPU 40 determines in S104 that the ascending flank of the detection level is detected, the process proceeds to S105. In S105, the CPU 40 determines whether the detection member 351 that has started free fall falls on the toner 28 and stops on the toner surface. In this embodiment, the CPU 40 determines that the detection member 351 stops on the toner surface when a variation of the detection level output from the electrostatic capacitance sensor 33 is 2 or less for 0.05 seconds (50 msec) or more. Settings of a variation width and a time of the detection level of the electrostatic capacitance sensor 33 for detecting timing when the detection member 351 stops on the toner surface change depending on a developing unit configuration, an electrostatic capacitance sensor, and a peripheral circuit, and are thus not limited to this. In S105, if the variation width of the detection level output from the electrostatic capacitance sensor 33 to the CPU 40 is 2 or less for 0.05 seconds or more, the CPU 40 proceeds to S106, and if not, the CPU 40 proceeds to S108.

In S108, the CPU 40 reads a timer value from a timer, determines whether 2 seconds or more have passed since the start of reading of the detection level by the electrostatic capacitance sensor 33. When 2 seconds have not passed, the CPU 40 returns to S103. When 2 seconds or more have passed, the CPU 40 proceeds to S109. In S109, since the detection level of the electrostatic capacitance sensor 33 does not exceed the ascending flank threshold value by 2 seconds or more, the CPU 40 determines an abnormality of the electrostatic capacitance sensor 33, and notifies the video controller 42.

In S106, the CPU 40 checks the detection level output from the electrostatic capacitance sensor 33 in S103 against the detection level in the table T1 stored in the ROM of the storage section to calculate a corresponding remaining amount of toner 28. In S107, the CPU 40 notifies the video controller 42 of the remaining amount of toner 28 calculated in S106.

As described above, according to this embodiment, a remaining amount can be successively detected with high accuracy irrespective of an amount of toner with a simple configuration. In this embodiment, the electrostatic capacitance between the electrode to be detected of the detection member and the electrostatic capacitance sensor electrode provided on the bottom surface of the developing unit is detected to allow a remaining amount of toner corresponding to the electrostatic capacitance to be calculated, thereby allowing a remaining amount to be successively detected from a full state to an empty state of toner.

Embodiment 2

In Embodiment 1, the electrostatic capacitance between the electrode to be detected of the detection member and the electrostatic capacitance sensor electrode on the bottom surface of the developing unit is detected to calculate a remaining amount of toner with constant sensitivity of the electrostatic capacitance sensor. In contrast to this, in this embodiment, an example will be described in which sensitivity of an electrostatic capacitance sensor is changed depending on a remaining amount of toner to further increase detection accuracy of the remaining amount of toner as compared to Embodiment 1. The configurations in FIGS. 1, 2, 3A and 3B described in Embodiment 1, and the detection operations in FIGS. 4A to 4C, FIG. 5A to 5D are also applied in this embodiment. The same components as in Embodiment 1 are denoted by the same reference numerals, and descriptions thereof in this embodiment will be omitted since the detailed descriptions have been made in Embodiment 1.

(Detection Characteristic of Detection of Remaining Amount of Toner)

Figure 9A:
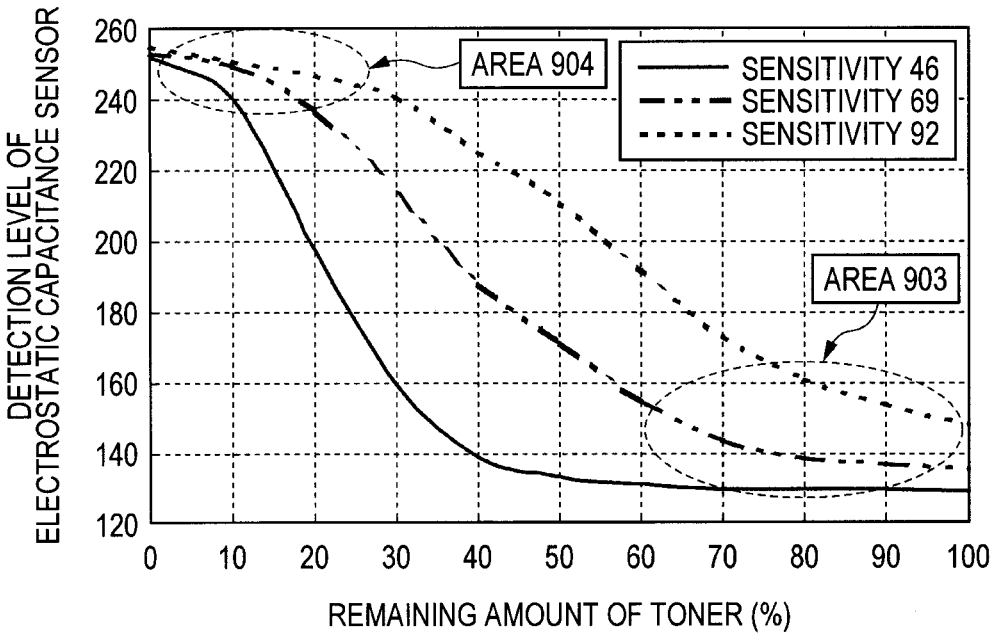
FIG. 9A is a characteristic graph according to sensor sensitivity and FIG. 9B are is a characteristic graph with sensor sensitivity being changed depending on a remaining amount of toner in Embodiment 2.

FIG. 9A is a characteristic graph of a remaining amount of toner 28 and a detection level of an electrostatic capacitance sensor for each sensitivity set in an electrostatic capacitance sensor 33, the ordinate represents the detection level and the abscissa represents the remaining amount of toner (%). In FIG. 9A, a graph plotted by a solid line represents characteristics of the remaining amount of toner 28 and the detection level of the electrostatic capacitance sensor 33 at sensitivity of 46, a graph plotted by a dash-double-dot line represents the characteristics at sensitivity of 69, and a graph plotted by a broken line represents the characteristics at sensitivity of 92. From the characteristic graph at the sensitivity of 69 in FIG. 9A, it is found that in an area with the remaining amount of toner 28 of 25% or less and an area with the remaining amount of toner 28 of 60% or more, the rate of change in the detection level of the electrostatic capacitance sensor 33 with respect to the change in the remaining amount of toner is low, and determination of the remaining amount of toner with high accuracy is difficult.

From the characteristic graph at the sensitivity of 92, the rate of change in the detection level of the electrostatic capacitance sensor 33 with respect to the change in the remaining amount of toner is high in an area 903 with a large remaining amount of toner 28 (remaining amount of toner 28 of 60% to 100%) as compared to the characteristic graph at the sensitivity of 69. From the characteristic graph at the sensitivity of 46, the rate of change in the detection level of the electrostatic capacitance sensor 33 with respect to the change in remaining amount of toner is high in an area 904 with a small remaining amount of toner 28 (remaining amount of toner of 0% to 25%) as compared to the characteristic graph at the sensitivity of 69. Thus, higher sensitivity is set in the electrostatic capacitance sensor 33 in the area 903 in FIG. 9A, and lower sensitivity is set in the electrostatic capacitance sensor 33 in the area 904 to detect the electrostatic capacitance. This can increase detection accuracy of the remaining amount of toner 28 as compared to Embodiment 1.

Figure 9B:
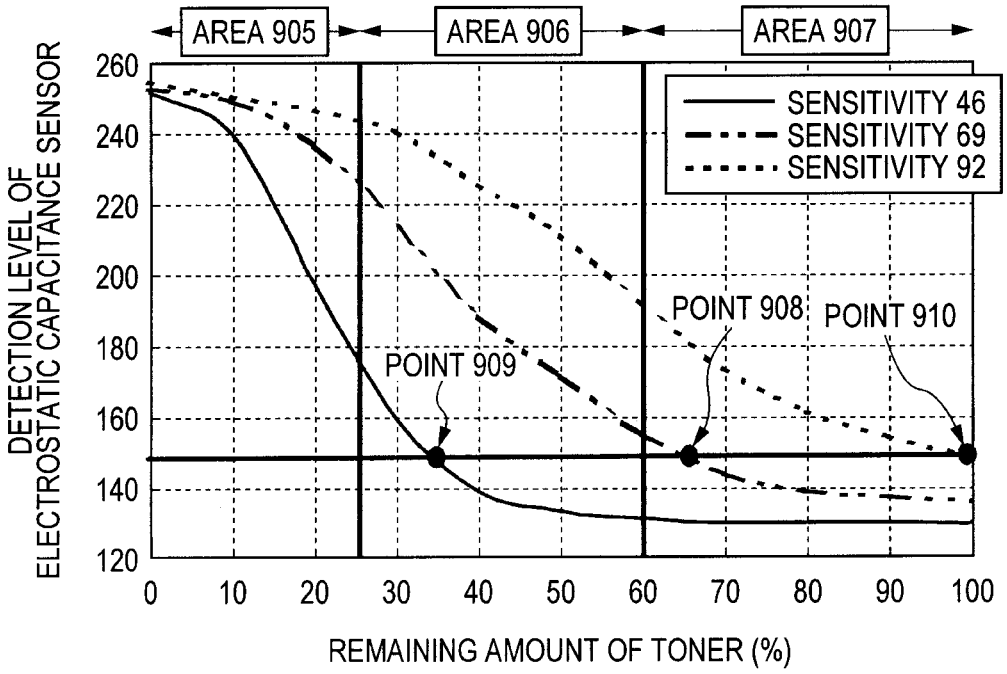

FIG. 9B illustrates the characteristic graph in FIG. 9A divided into areas according to the sensitivities set in detection of the electrostatic capacitance. In this embodiment, the sensitivity set in the electrostatic capacitance sensor 33 is 46 in an area 905 with a remaining amount of toner of less than 25%, 69 in an area 906 with a remaining amount of toner of 25% to less than 60%, and 92 in an area 907 with a remaining amount of toner of 60% or more. The sensitivity set according to the remaining amount of toner changes depending on a developing unit configuration, an electrostatic capacitance sensor 33, and a peripheral circuit, and is not limited to the values set in this embodiment.

Tables T1 to T3 in FIGS. 10A to 10C illustrate correspondence between the detection level of the electrostatic capacitance sensor 33 and the remaining amount of toner (%) from the characteristic graph in FIG. 9A. The table T1 in FIG. 10A illustrates the characteristic graph at the sensitivity of 69, the table T2 in FIG. 10B illustrates the characteristic graph at the sensitivity of 46, and the table T3 in FIG. 10C illustrates the characteristic graph at the sensitivity of 92. The remaining amount of toner 28 corresponding to a detection level that is not specified in the tables can be calculated by a linear interpolation of the known remaining amounts of toner 28 described in the table. Since the measured detection level is a value in this embodiment, the measured detection level changes depending on measurement conditions. The same applies to values in the tables for determining the remaining amount of toner 28.

(Process Sequence of Detection of Remaining Amount of Toner)

Figure 11:
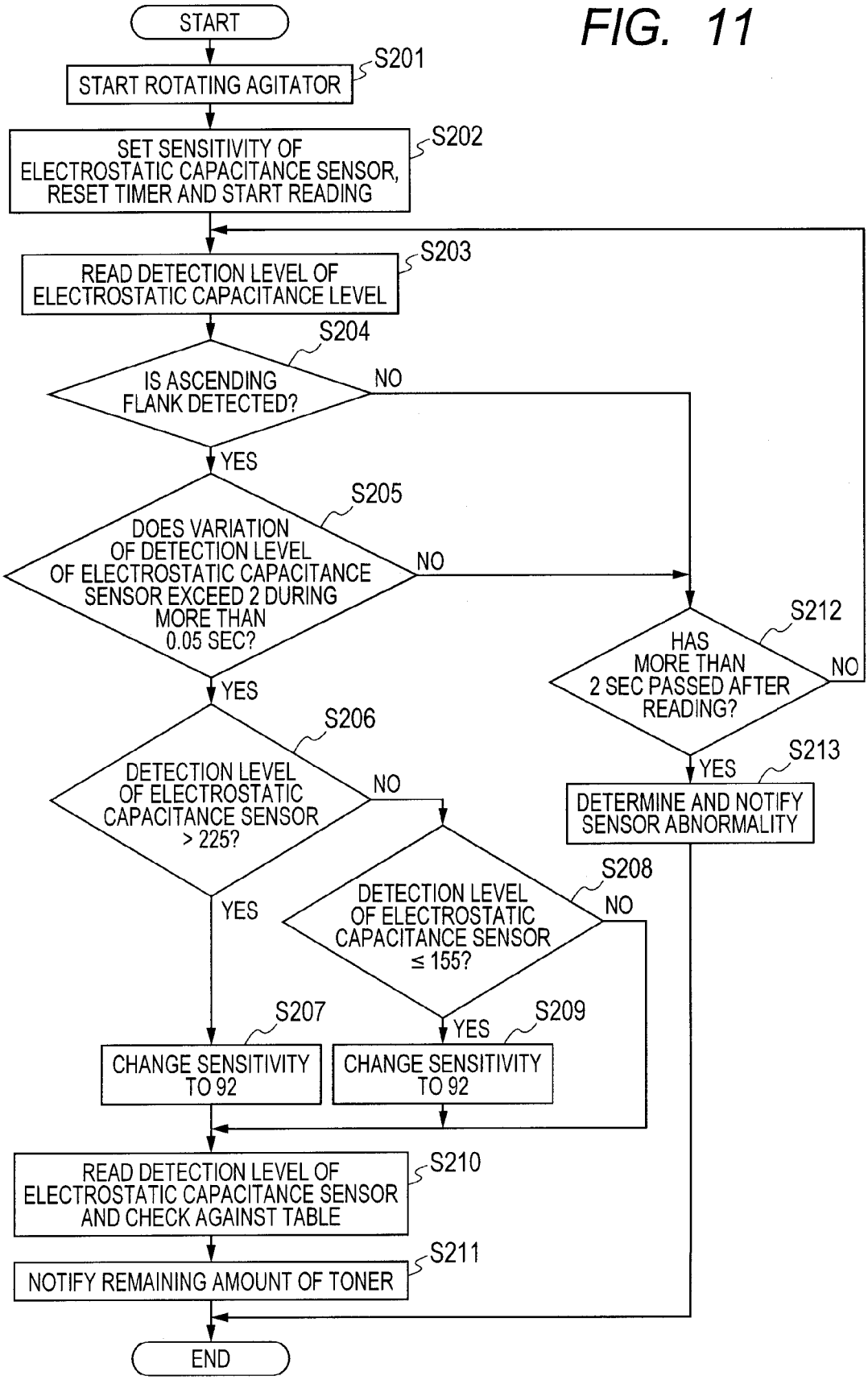
FIG. 11 is a flowchart of a process sequence of detection of a remaining amount of toner in Embodiment 2.

Next, with reference to a flowchart in FIG. 11, a process sequence of detection of the remaining amount of toner in this embodiment will be described. The processes in S201 to S205, S212, and S213 in FIG. 11 are the same as S101 to S105, S108, and S109 in the flowchart in FIG. 7 in Embodiment 1, and thus descriptions thereof will be omitted.

In S206, as described above, the CPU 40 determines the remaining amount of toner at the sensitivity of 69 from the detection level output from the electrostatic capacitance sensor 33 in S203 in order to set the sensitivity of the electrostatic capacitance sensor 33 according to the remaining amount of toner 28. When the CPU 40 determines that the detection level is higher than 225, and the remaining amount of toner 28 at the sensitivity of 69 is less than 25%, the CPU 40 proceeds to S207. In S207, the sensitivity of the electrostatic capacitance sensor 33 is changed to 46, and the CPU 40 proceeds to S210. When the CPU 40 determines in S206 that the detection level is 225 or less, the CPU 40 proceeds to S208, and in S208, the CPU 40 determines whether the detection level is higher than 155. When the detection level is higher than 155, the remaining amount of toner 28 is 25% to less than 60%. Thus, the CPU 40 keeps the sensitivity of the electrostatic capacitance sensor 33 at 69 and does not change the sensitivity, and the CPU 40 proceeds to S210. When the detection level is 155 or less, the CPU 40 determines that the remaining amount of toner 28 is 60% or more, and the CPU 40 proceeds to S209. In S209, the CPU 40 changes the sensitivity of the electrostatic capacitance sensor 33 to 92, and proceeds to S210.

In S210, the CPU 40 again reads the detection level from the electrostatic capacitance sensor 33 using the sensitivity according to the remaining amount of toner 28 determined in the processes in S206 to S209. The CPU 40 checks the read detection level against the detection level in the table corresponding to the sensitivity stored in the ROM of the storage section to calculate a corresponding remaining amount of toner 28. In S211, the CPU 40 notifies the video controller 42 of the remaining amount of toner 28 calculated in S210.

As described above, according to this embodiment, a remaining amount can be successively detected with high accuracy irrespective of an amount of toner with a simple configuration. Specifically, the sensitivity of the electrostatic capacitance sensor is changed depending on the remaining amount of toner to calculate the remaining amount of toner from the table corresponding to the sensitivity and the detection level from the electrostatic capacitance sensor. This can further increase detection accuracy of the remaining amount of toner as compared to Embodiment 1.

Embodiment 3

In Embodiment 1, the electrostatic capacitance between the electrode to be detected of the detection member and the electrostatic capacitance sensor electrode on the bottom surface of the developing unit is detected to calculate the remaining amount of toner with constant sensitivity of the electrostatic capacitance sensor. In Embodiment 2, the sensitivity of the electrostatic capacitance sensor is changed depending on the remaining amount of toner to increase the detection accuracy of the remaining amount of toner as compared to Embodiment 1. In this embodiment, an example will be described in which sensitivity of an electrostatic capacitance sensor is swept with a detection member stopping on a toner surface, and a remaining amount of toner is calculated from a value of sensitivity when a target value and a measured value of a detection level match to further increase detection accuracy of a remaining amount of toner. In Embodiments 1 and 2, the remaining amount of toner is successively detected while the agitator is being rotated. However, in this embodiment, it takes time to sweep the sensitivity of the electrostatic capacitance sensor, and thus rotation of an agitator is stopped with the detection member stopping on the toner surface to detect a remaining amount.

The configurations in FIGS. 1, 2 and 3A and 3B described in Embodiment 1, and the detection operations in FIGS. 4A to 4C and 5A to 5D are also applied in this embodiment. The same components as in Embodiment 1 are denoted by the same reference numerals, and descriptions thereof in this embodiment will be omitted since the detailed descriptions have been made in Embodiment 1.

(Detection Characteristic of Detection of Remaining Amount of Toner)

Figures 12A, 12B:
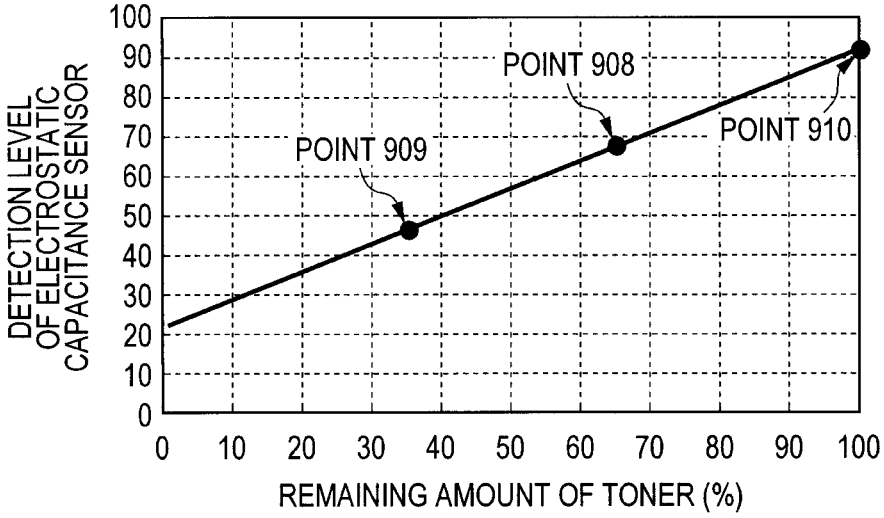
FIG. 12A is a characteristic graph and FIG. 12B is a table T4 in Embodiment 3.

FIG. 12A is a characteristic graph illustrating a relationship between a remaining amount of toner 28 and sensitivity of an electrostatic capacitance sensor at which a target value and a measured value of the detection level of the electrostatic capacitance sensor 33 match when the sensitivity is swept. The ordinate represents sensitivity and the abscissa represents a remaining amount of toner (%). In this embodiment, a target value of the detection level of the electrostatic capacitance sensor 33 is set to 150. For example, a point 908 in FIG. 12A indicates that the sensitivity of the electrostatic capacitance sensor 33 is swept at a remaining amount of toner 28 of 66%, and the sensitivity of the electrostatic capacitance sensor is 69 when the detection level of the electrostatic capacitance sensor reaches the target value 150. Points 909 and 910 are similar, the point 909 indicates that the sensitivity of the electrostatic capacitance sensor 33 is 46 when the remaining amount of toner 28 is 35%, and the point 910 indicates that the sensitivity of the electrostatic capacitance sensor 33 is 92 when the remaining amount of toner 28 is 100%. Thus, the relationship between the remaining amount of toner and the sensitivity of the electrostatic capacitance sensor when the detection level of the electrostatic capacitance sensor 33 is 150 is plotted according to each remaining amount of toner 28 to provide the characteristic graph in FIG. 12A. The characteristic graph has linearity in the relationship between the remaining amount of toner 28 and the detected sensitivity of the electrostatic capacitance sensor 33. This allows the remaining amount of toner to be successively detected with higher accuracy than in Embodiments 1 and 2 from a full state to an empty state of toner. The relationship among the target value of the detection level of the electrostatic capacitance sensor 33, the remaining amount of toner, and the sensitivity used herein changes depending on a developing unit configuration, an electrostatic capacitance sensor, and a peripheral circuit, and is thus not limited to the values and the characteristic graph described above.

FIG. 12B is a table T4 illustrating correspondence between the sensitivity of the electrostatic capacitance sensor 33 and the remaining amount of toner (%) from the characteristic graph in FIG. 12A. A remaining amount of toner 28 corresponding to sensitivity that is not specified in the table T4 can be calculated by a linear interpolation of the known remaining amounts of toner 28 described in the table T4. Since the measured sensitivity of the electrostatic capacitance sensor 33 is a value in this embodiment, the measured sensitivity of the electrostatic capacitance sensor changes depending on conditions of the electrostatic capacitance sensor and the peripheral circuit. The same applies to values in the table T4 for determining the remaining amount of toner 28.

(Process Sequence of Detection of Remaining Amount of Toner)

Figure 13:
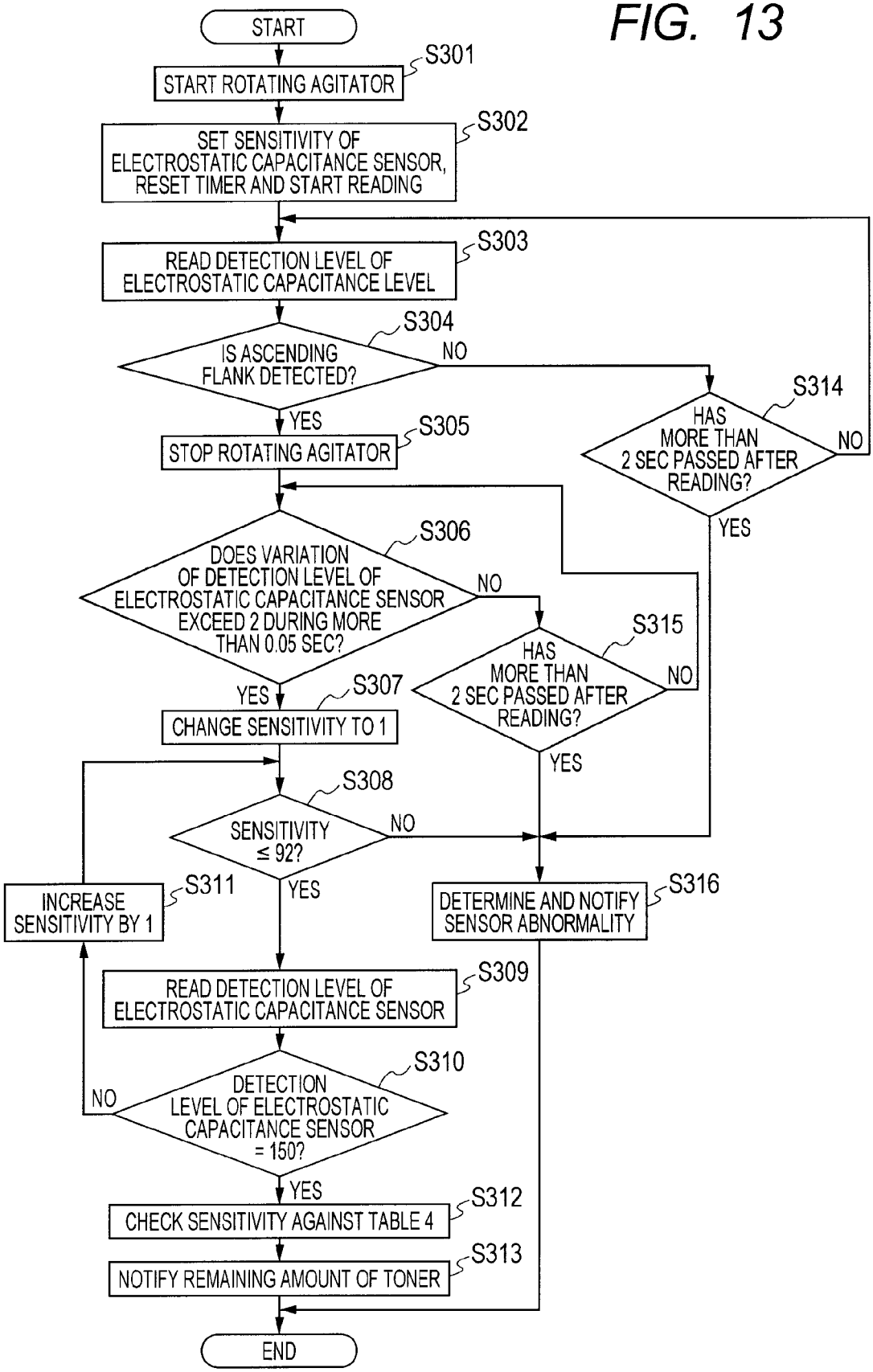
FIG. 13 is a flowchart of a process sequence of detection of a remaining amount of toner in Embodiment 3.

Next, with reference to a flowchart in FIG. 13, a process sequence of detection of the remaining amount of toner in this embodiment will be described. The processes in S301 to S304, S314 and S316 in FIG. 13 are the same as S101 to S105, S108, and S109 in the flowchart in FIG. 7 in Embodiment 1, and thus descriptions thereof will be omitted.

In S304, when the CPU 40 determines that an ascending flank of the detection level is detected, the CPU 40 proceeds to S305. In S305, the CPU 40 stops rotation of the agitator 34 before the agitator 34 is rotated to abut against the detection member 351. The rotation of the agitator 34 is stopped because it takes time for the CPU 40 to sweep the sensitivity of the electrostatic capacitance sensor 33 from 1 to 92 to read the detection level of the electrostatic capacitance sensor with the detection member 351 stopping on the toner surface of the toner container 23. When the time for the CPU 40 to sweep the sensitivity of the electrostatic capacitance sensor 33 to read the detection level is shorter than a stopping time of the detection member 351 on the toner surface, the remaining amount of toner 28 may be detected while the agitator 34 is being rotated.

In S306, the CPU 40 determines whether the detection member 351 that has started free fall falls on the toner 28 and stops on the toner surface. Also in this embodiment, as in Embodiments 1 and 2, the CPU 40 determines that the detection member 351 stops on the toner surface when a variation in the detection level output from the electrostatic capacitance sensor 33 is 2 or less for 0.05 seconds (50 msec) or more. Settings of a variation width and a time of the detection level of the electrostatic capacitance sensor 33 for detecting timing when the detection member 351 stops on the toner surface change depending on a developing unit configuration, an electrostatic capacitance sensor, and a peripheral circuit, and is thus not limited to this. If the variation width of the detection level output from the electrostatic capacitance sensor 33 to the CPU 40 is 2 or less for 0.05 seconds or more, the CPU 40 proceeds to S307, and if not, the CPU 40 proceeds to S315. In S315, the CPU 40 reads a timer value from a timer, determines whether 2 seconds or more have passed since the start of reading of the detection level by the electrostatic capacitance sensor 33. When 2 seconds have not passed, the CPU 40 returns to S306. When 2 seconds or more have passed, the CPU 40 proceeds to S316. In S316, since the detection level of the electrostatic capacitance sensor 33 has not exceed the ascending flank threshold value for 2 seconds or more, the CPU 40 determines an abnormality of the electrostatic capacitance sensor 33, and notifies a video controller 42.

In S307, the CPU 40 performs serial communication with the electrostatic capacitance sensor 33, and sets the sensitivity of the electrostatic capacitance sensor to 1 as an initial value in order to sweep the sensitivity of the electrostatic capacitance sensor 33 to continuously read the detection level of the electrostatic capacitance sensor.

In S308, the CPU 40 determines whether the sensitivity set in the electrostatic capacitance sensor 33 by serial communication is 92 or less. When the set sensitivity of the electrostatic capacitance sensor 33 is larger than 92, the CPU 40 proceeds to S316, and in S316, the CPU 40 notifies the video controller 42 of the abnormality of the electrostatic capacitance sensor 33. When the sensitivity is 92 or less, the CPU 40 proceeds to S309. In S309, the CPU 40 again reads the detection level from the electrostatic capacitance sensor 33, and in S310, the CPU 40 compares the detection level with the target value 150. When the measured value and the target value of the detection level of the electrostatic capacitance sensor 33 match, the CPU 40 proceeds to S312. When the measured value and the target value of the detection level do not match in S310, the CPU 40 proceeds to S311, performs serial communication with the electrostatic capacitance sensor 33, increases the sensitivity of the electrostatic capacitance sensor 33 by one, and returns to S308.

In S312, the CPU 40 checks the value of the sensitivity of the electrostatic capacitance sensor 33 set at that time against the sensitivity in the table T4 stored in the ROM of the storage section to calculate a corresponding remaining amount of toner 28. In S313, the CPU 40 notifies the video controller 42 of the remaining amount of toner calculated in S312.

As described above, according to this embodiment, a remaining amount can be successively detected with high accuracy irrespective of an amount of toner with a simple configuration. Specifically, the sensitivity of the electrostatic capacitance sensor is swept with the detection member stopping on the toner surface, and the remaining amount of toner is calculated from the sensitivity when the target value and the measured value of the detection level match to further increase detection accuracy of the remaining amount of toner as compared to Embodiments 1 and 2.

In Embodiments 1 to 3, checking of the detection level of the electrostatic capacitance sensor obtained by one time detection against the table is described for easy understanding. However, it is expected that averaging data of a plurality of times of detection and then checking the data against each table further increases detection accuracy. In Embodiments 1 to 3, an example of the developing unit having an integral configuration is taken. However, the present invention can be applied to a supply toner container including a developing roller and a toner container separately provided by providing an electrode to be detected and a detection member in the toner container.

Embodiment 4

A configuration of an image forming apparatus in this embodiment is the same as in Embodiment 1 above, and descriptions thereof will be omitted.

(Configuration of Developing Unit)

Figure 14A:
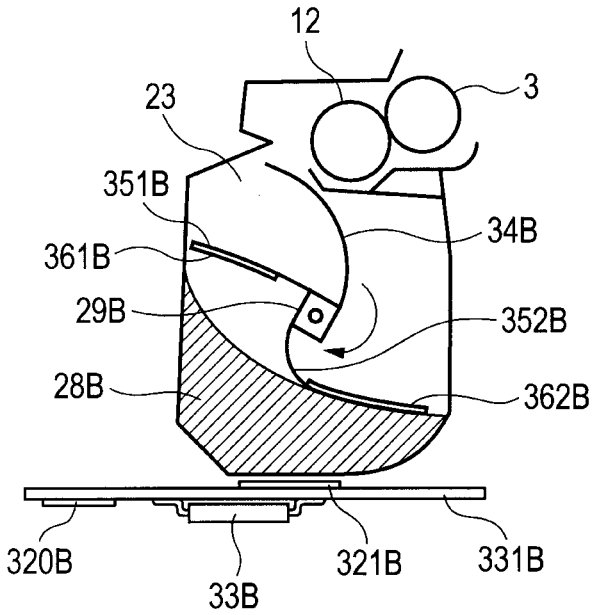
FIG. 14A is a sectional view of a developing unit and FIG. 14B shows an electrostatic capacitance sensor board in Embodiments 4 and 6.

FIG. 14A is a sectional view of a developing unit and an electrostatic capacitance sensor board 331B that constitute the process cartridge 5. The developing unit of the process cartridge 5 in FIG. 14A includes a toner 28B corresponding to each color in a toner container 23, and an agitator 34B that agitates the toner 28B in the toner container 23. The agitator 34B (agitation member) is provided on a rotation axis 29B in the toner container 23 and moved around. The rotation axis 29B includes a flexible detection member 351B (first member) and a detection member 352 (second member) for detecting a remaining amount of toner. The detection member 352B is placed 90° (a predetermined angle) behind the detection member 351B in a rotational direction. The angle is not limited to 90°. Specifically, the angle may be set so that there is a difference between a time difference between detection of the detection member 351B and detection of the detection member 352B using an electrostatic capacitance sensor IC33B described later, and a time difference between detection of the detection member 352B and detection of the detection member 351B using the electrostatic capacitance sensor IC33B. Details will be described in the process in the flowchart in FIGS. 6A and 6B described later. The angle may be set so that the detection member 351B and the detection member 352B do not come into contact with each other.

The detection members 351B and 352B are formed of general-purpose polyester films. In this embodiment, the detection members 351B and 352B have thickness of, for example, 150 μm and 75 μm, respectively. A difference in amount of deflection is achieved by the detection members 351B and 352B having different thicknesses. Thus, the detection member 352B has a larger amount of deflection than the detection member 351B. For example, the detection member 352 may have a larger amount of deflection than the detection member 351B such that the detection members 352B and 351B are formed of different materials and thus the detection member 352B has a larger amount of deflection. Conductive electrodes to be detected 361B (first electrode) and 362B (second electrode) are provided near tips of the detection members 351B and 352B in a circumferential direction (direction perpendicular to the rotation axis).

The electrostatic capacitance sensor board 331B in FIG. 14A includes the following. The electrostatic capacitance sensor board 331B provided in the main body 101 includes the electrostatic capacitance sensor IC33B (output section) and a peripheral circuit component (not shown) of the electrostatic capacitance sensor IC33B. The electrostatic capacitance sensor IC33B in this embodiment uses, for example, a difference between electrostatic capacitance of an electrostatic capacitance sensor electrode and electrostatic capacitance of a reference electrode to detect a change in the electrostatic capacitance of the electrostatic capacitance sensor electrode. On the electrostatic capacitance sensor board 331B, an electrostatic capacitance sensor electrode 321 (third electrode) and a reference electrode 320B are formed in a copper foil pattern. A bottom surface of an exterior of the developing unit is brought close to the electrostatic capacitance sensor electrode 321B when the process cartridge 5 is mounted to the main body 101. In this state, the electrostatic capacitance sensor IC33B detects the change in the electrostatic capacitance caused by the electrode to be detected 361B or 362B provided on the detection member 351B or 352B being brought close to the electrostatic capacitance sensor electrode 321B. The electrostatic capacitance sensor IC33B and the peripheral circuit may be those that can detect an electrostatic capacitance, and an analogue integrated circuit may be used. In this embodiment, the electrostatic capacitance sensor electrode 321B is formed on the electrostatic capacitance sensor board 331B provided in the main body 101B, but may be provided near a wall surface of the developing unit. For example, the electrostatic capacitance sensor electrode 321B may be directly formed on the wall surface of the developing unit. In this case, electrical contacts may be provided on the electrostatic capacitance sensor board 331B and the electrostatic capacitance sensor electrode 321B and connected when the process cartridge 5 is mounted to the main body 101.

Figure 14B:
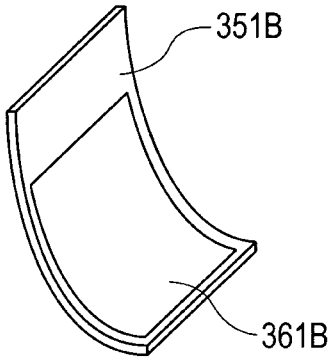

FIG. 14B is a perspective view of a positional relationship between the detection member 351B and the electrode to be detected 361B. The same applies to the detection member 352B and the electrode to be detected 362B. A length of each of the electrode to be detected 361B and 362B in the circumferential direction (direction perpendicular to the rotation axis 29) is 30 mm. Lengths of the detection members 351B and 352B and the electrodes to be detected 361B and 362B in an axial direction of the rotation axis 29B (longitudinal direction) may be enough to cover at least a detection surface of the electrostatic capacitance sensor IC33B. The circumferential length of the detection member 352B is longer than that of the detection member 351B in this embodiment. The detection member 351B has a circumferential length enough to come into contact with a side wall surface of the toner container 23, while the detection member 352B has a circumferential length enough to come into contact with the bottom surface of the process cartridge 5. The detection members 351B and 352B have lengths such that the agitators do not come into contact with each other during agitation of the toner. The agitator 34B has a length enough to sufficiently agitate the toner in the process cartridge 5. The agitator 34B and the detection member 352B are placed at an angle of about 180° in FIG. 2A so that the toner is agitated by the agitator 34B, and after the toner is stabilized to some extent, detection by the detection member 352B is performed. Specifically, the agitator 34B and the detection member 352B may be placed so that the electrode to be detected 362B on the detection member 352B can be detected with the toner being stabilized to some extent after agitation of the toner by the agitator 34B, and the angle is not limited to 180°. The detection member 352B is placed 90° behind the detection member 351 in the rotational direction, and is more flexible than the detection member 351B, but the placement, the material, and the thickness are not limited to these.

(Circuit Diagram of Detection of Remaining Amount of Toner)

Figure 15:
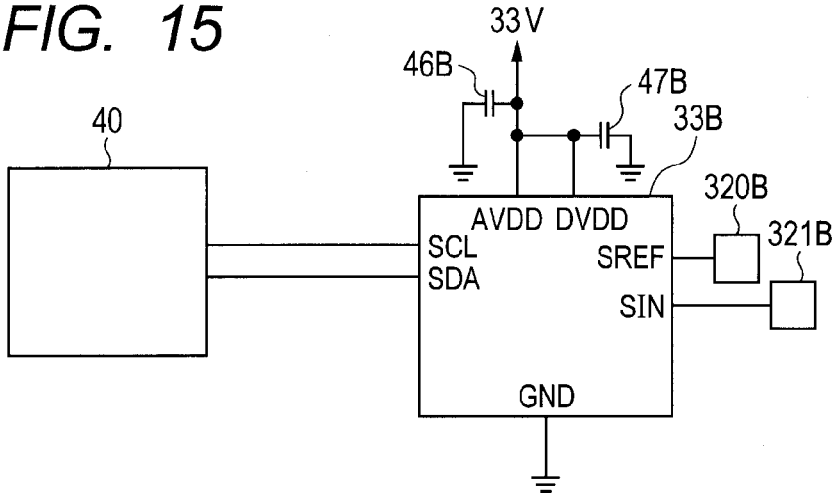
FIG. 15 is a circuit diagram of detection of a remaining amount of toner in Embodiments 4 to 7.

FIG. 15 is a circuit diagram of detection of a remaining amount of toner in this embodiment. A bypass capacitor 46 removes noise of an analogue power supply terminal AVDD of the electrostatic capacitance sensor IC33B. The bypass capacitor 47 removes noise of a digital power supply terminal DVDD of the electrostatic capacitance sensor IC33B. A reference electrode 320B is connected to an SREF terminal of the electrostatic capacitance sensor IC33B, and the electrostatic capacitance sensor electrode 321B is connected to an SIN terminal. The reference electrode 320B and the electrostatic capacitance sensor electrode 321B are provided in a copper foil pattern having the same area. The electrostatic capacitance sensor IC33B transmits and receives data to and from the CPU 40 by serial communication. The CPU 40 outputs a clock signal for synchronizing communication to an SCL terminal of the electrostatic capacitance sensor IC33B. Meanwhile, the electrostatic capacitance sensor IC33B outputs 8-bit data (information on an electrostatic capacitance) on the detection level corresponding to a detected electrostatic capacitance value via an SDA terminal to the CPU 40. A detailed operation principle of the electrostatic capacitance sensor IC33B is a known technique, and is thus omitted.

(Operation of Detection Member)

Figure 16A:
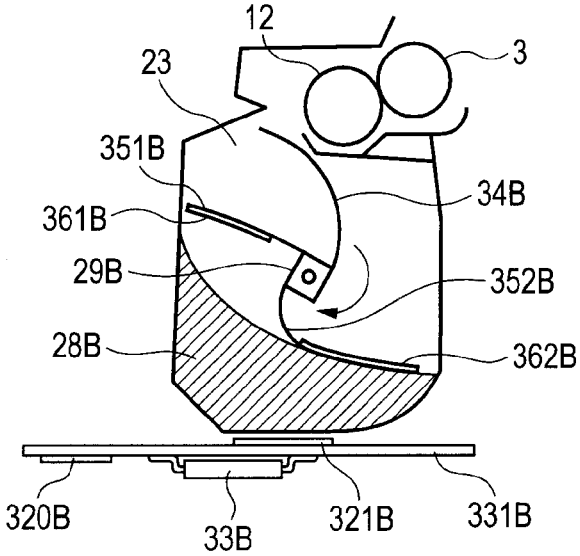
FIGS. 16A and 16B are sectional views of a developing unit and an electrostatic capacitance sensor board in Embodiment 4.
Figure 16B:
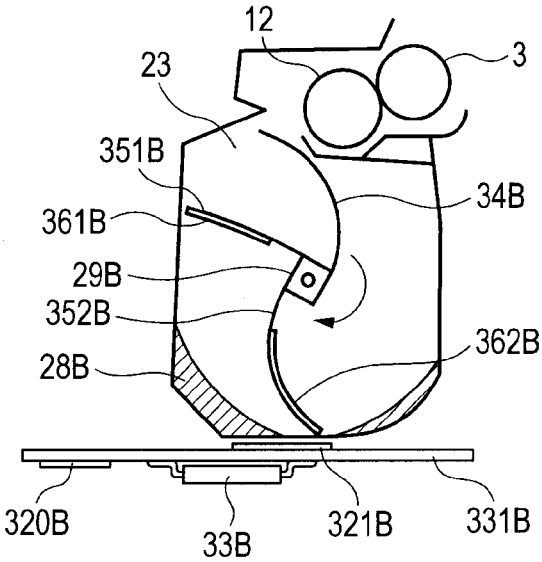

With reference to FIGS. 16A and 16B, operations will be described of the detection members 351B and 352B in the case with a relatively large remaining amount of toner and the case with a relatively small amount of toner. When the detection members 351B and 352B are rotated, in the case with a relatively large remaining amount of toner as shown in FIG. 16A, the detection members 351B and 352B receive resistance of the toner and are deformed backward in the rotational direction in the arrow direction in the drawing, and rotated while being flexed. At this time, the amount of deflection of the detection member 352B is larger than that of the detection member 351B, and the detection member 352B is significantly deformed rearward in the rotational direction. In this state, a difference between a time when the detection member 351B reaches the detection surface of the electrostatic capacitance sensor electrode 321 and a time when the detection member 352 reaches the detection surface of the electrostatic capacitance sensor electrode 321B (hereinafter referred to as time difference) is long. On the other hand, as shown in FIG. 16B, in the case with a relatively small remaining amount of toner, the amount of deflection of the detection member 352B is reduced more than that of the detection member 351B. This reduces the time difference between when the detection member 351B reaches the detection surface of the electrostatic capacitance sensor electrode 321B and when the detection member 352B reaches the detection surface of the electrostatic capacitance sensor electrode 321B. This principle is used to detect the remaining amount of toner.

(Characteristic of Detection of Remaining Amount of Toner)

With reference to FIGS. 17A, 17B and 17C, the detection characteristic of the remaining amount of toner in this embodiment will be described. As described above, the electrostatic capacitance sensor IC33B outputs 8-bit data corresponding to the detected electrostatic capacitance value to the CPU 40. In this embodiment, the 8-bit data output to the CPU 40 by the electrostatic capacitance sensor IC33B is displayed as a decimal detection level for description. FIG. 17A is a characteristic graph of a remaining amount of toner (%) and a time difference (millisecond) between the detection member 351B and the detection member 352B detected by the electrostatic capacitance sensor IC33B. As shown in FIGS. 4A to 4C, the time difference increases with increasing remaining amount of toner, and decreases with decreasing remaining amount of toner. Thus, the remaining amount of toner can be detected by measuring the time difference. FIG. 17B illustrates waveform data when the remaining amount of toner is 65%, the abscissa represents time (msec), and the ordinate represents the detection level of the electrostatic capacitance sensor IC33B. It is found that the time difference (msec) between the time of detection of the detection member 351 and the time of detection of the detection member 352B is 390 msec.

FIG. 17C is a table T illustrating correspondence between the time difference and the remaining amount of toner. A remaining amount of toner between the values in the table is calculated using a known linear interpolation. Since the measured time value is a value in this embodiment, the measured time changes depending on conditions. The same applies to values in the table T for determining the remaining amount of toner. Information in the table T is previously written on an ROM of a storage section or an ROM provided in the process cartridge 5 in a factory and shipped. The information in the table T written on the ROM provided in the process cartridge 5 is read by the CPU 40 when the process cartridge 5 is mounted to the main body 101, and stored in a RAM of the storage section on a control board 80. Also in Embodiments 5 and 6 described later, table information is recorded in an ROM or an RAM of a storage section by such a method. The method of recording the table information in shipment described above is an example, and not limited to this.

(Flowchart of Detection of Remaining Amount of Toner)

With reference to flowcharts in FIGS. 18A and 18B, a process of detection of the remaining amount of toner in this embodiment will be described. The process in the flowchart is performed by the CPU 40, and this applies to flowcharts in embodiments described later. However, not limited to this, for example, when an integrated circuit (ASIC) for characteristic use is mounted in the image forming apparatus, the ASIC may have a function of performing any of steps. In Step (hereinafter referred to as S) 101B, the CPU 40 rotates the detection member 351B and the detection member 352B. In this embodiment, it takes about 1 second for the detection members to rotate one turn. In S102B, the CPU 40 performs serial communication with the electrostatic capacitance sensor IC33B using the circuit in FIGS. 3A to 3C to start reading of the detection level of the electrostatic capacitance sensor IC33B. The CPU 40 resets a timer α (not shown) at the same time as reading of the detection level and starts measurement of time from the start of reading of the detection level of the electrostatic capacitance sensor IC33B.

In S103B to S105B, the CPU 40 calculates an initial value of the detection level of the electrostatic capacitance sensor IC33B. First, in S103B, the CPU 40 sets a tentative initial value of the detection level of the electrostatic capacitance sensor IC33B. The CPU 40 starts reading (hereinafter also referred to as monitor) of the detection level of the electrostatic capacitance sensor IC33B and then measures the detection level at a plurality of points, and stores the measured plurality of pieces of data in a memory, for example, a RAM (not shown). The CPU 40 calculates an average value of the detection level of the electrostatic capacitance sensor IC33B from the plurality of pieces of data stored in the memory, and the average value is set as the tentative initial value. In this embodiment, for example, ten-point measurement is performed to calculate the average value. However, the average value by the ten-point measurement is an example, and not limited to this. The CPU 40 calculates the tentative initial value, and resets a timer β (not shown) and starts measurement of time by the timer β.

In S104B, the CPU 40 determines whether the tentative initial value calculated in S103B is a reliable value, that is, whether the tentative initial value is in a stable reference level and is suitable as an initial value. Subsequent to S103B, the CPU 40 monitors the detection level of the electrostatic capacitance sensor IC33B. For example, the CPU 40 determines that the obtained detection level of the electrostatic capacitance sensor IC33B is within a certain range and thus the calculated tentative initial value is in a stable reference level. In this embodiment, for example, a determination reference is set so that the monitored detection level of the electrostatic capacitance sensor IC33B is within a range of the tentative initial value±10% for 0.3 seconds (sec) with reference to the timer β. When the CPU 40 determines in S104B that the monitored detection level of the electrostatic capacitance sensor IC33B is within the range of the tentative initial value±10% for 0.3 seconds, in S105B, the CPU 40 sets the tentative initial value calculated in S103B as the initial value. The initial value set in S105B is used for calculating a threshold value of a different timer described later.

On the other hand, when the CPU 40 determines in S104B that the monitored detection level of the electrostatic capacitance sensor IC33B is not within the range of tentative initial value±10% for 0.3 seconds, the CPU 40 determines an error in S117B. In this embodiment, the CPU 40 determines an error based on whether 2.0 seconds or more have passed since the start of monitoring the detection level of the electrostatic capacitance sensor IC33B, that is, since the start of reading with reference to the timer α. When the CPU 40 determines in S117B that 2.0 seconds have not passed since the start of reading of the detection level of the electrostatic capacitance sensor IC33B, the CPU 40 resets the tentative initial value calculated in S103B, performs the processes in S103B to S105B, and again calculates the tentative initial value. Meanwhile, when the CPU 40 determines in S117B that 2.0 seconds or more have passed since the start of reading of the detection level of the electrostatic capacitance sensor IC33B, the CPU 40 determines an abnormality in S118B, and notifies the video controller 42.

Next, in S106B to S109B, the CPU 40 determines whether the detection member 351B of the two detection members is detected. This is because the table T for determining the remaining amount of toner is based on a time between detection of the detection member 351B and detection of the detection member 352. As a method of reliably detecting the detection member 351B, in one cycle of the detection member, a time between detection of a first ascending flank threshold value and detection of a second ascending flank threshold value is compared with a time between detection of the second ascending flank threshold value and detection of a third ascending flank threshold value. In the configuration of this embodiment, a longer time difference corresponds to the time between detection of the detection member 352B and detection of the detection member 351B. The CPU 40 uses a timer A (not shown) to measure the time between the ascending flank threshold values, and compares the measured time with a desired time to detect the detection member 351.

In S106B, the CPU 40 resets and then starts the timer A, and starts measuring the time. In S107B, the CPU 40 detects timing when electrostatic capacitance between the electrode to be detected (361B or 362B) provided on the detection member (351B or 352B) and the electrostatic capacitance sensor electrode 321B starts changing to the ascending flank threshold value or more. In this stage, the CPU 40 cannot determine whether the detected timing is the detection member 351B or the detection member 352B. In this embodiment, the ascending flank threshold value of the detection level of the electrostatic capacitance sensor IC33B is the initial value determined in S105+30%. Timing when the detection level exceeds the ascending flank threshold value is determined to be timing when either of the detection members reaches the detection surface of the electrostatic capacitance sensor electrode 321B. When the CPU 40 determines in S107B that the detection level of the electrostatic capacitance sensor IC33B is the ascending flank threshold value (initial value+30%) or more, the CPU 40 stops the timer A.

Meanwhile, when the CPU 40 determines in S107B that the detection level of the electrostatic capacitance sensor IC33B is less than the ascending flank threshold value, the CPU 40 determines an error in S119B. In this embodiment, the CPU 40 determines an error based on whether 2.0 seconds or more have passed since the timer A starts. When the CPU 40 determines in S119B that 2.0 seconds or more have not passed on the timer A, the CPU 40 returns to the process in S107B, and starts monitoring the detection level of the electrostatic capacitance sensor IC33B. Meanwhile, when the CPU 40 determines in S107B that 2.0 seconds or more have passed since the timer A starts, the CPU 40 proceeds to the process in S120. In S120B, the CPU 40 determines an abnormality such as non-detection of the electrode to be detected 361B, a failure of the electrostatic capacitance sensor IC33B, or a communication error between the CPU 40 and the electrostatic capacitance sensor IC33B, and notifies the video controller 42.

In S108B, the CPU 40 determines whether the timing detected in S107B is the timing when the detection member 351B reaches the detection surface of the electrostatic capacitance sensor electrode 321B. The CPU 40 reads a value of the stopped timer A, and determines whether the value of the timer A is within a predetermined specified range. In this embodiment, the specified range is, for example, 450 msec to 650 msec. For example, in the case of less than 450 msec, it cannot be determined whether the electrostatic capacitance sensor IC33B detects the detection member 351B or the detection member 352B. The predetermined specified range (time) is a value or more obtained by dividing a placement distance between the detection member 351B and the detection member 352B by a rotational speed of one turn, and needs to be smaller than the time for one turn. When the CPU 40 determines in S108B that the value of the timer A is within a specified range, the CPU 40 determines that the detection member 351B reaches the detection surface of the electrostatic capacitance sensor electrode 321B, that is, the detection member 351B is detected.

Meanwhile, when the CPU 40 determines in S108B that the value of the timer A is not within the specified range, the CPU 40 determines that the detection member 351B cannot be detected. In this case, the CPU 40 returns to the process in S106B, resets the timer A, and starts monitoring the detection level of the electrostatic capacitance sensor IC33B to again detect the detection member 351B. In S109B, the CPU 40 starts a timer B from the timing when the electrostatic capacitance between the electrode to be detected 361B on the detection member 351B and the electrostatic capacitance sensor electrode 321B changes to the ascending flank threshold value or more to start measurement of the time. The timer B measures a time difference between the timing of detection of the detection member 351B and the timing of detection of the detection member 352B.

Then, in S110B and S111B, the CPU 40 detects passage of the detection member 351B. In S110B, the CPU 40 detects timing when the electrostatic capacitance between the electrode to be detected 361B on the detection member 351B and the electrostatic capacitance sensor electrode 321B changes to a falling signal flank threshold value or less. In this embodiment, for example, the falling signal flank threshold value of the detection level is the initial value determined in S105B+20%. Timing when the detection level is lower than the falling signal flank threshold value is determined to be timing when the detection member 351B passes on the detection surface of the electrostatic capacitance sensor electrode 321B. When the CPU 40 determines in S110B that the detection level of the electrostatic capacitance sensor IC33B is not the falling signal flank threshold value (initial value±20%) or less, the CPU 40 determines an error in S121B. In this embodiment, when the CPU 40 determines in S121B that 2.0 seconds have not passed since the timer B starts, the CPU 40 returns to the process in S110B, and continues monitoring the electrostatic capacitance sensor IC33B. On the other hand, when the CPU 40 determines in S121B that 2.0 seconds or more have passed since the timer B starts, the CPU 40 proceeds to the process in S122B. In S122B, the CPU 40 determines an abnormality such as a failure of the electrode to be detected 361B, a failure of the electrostatic capacitance sensor IC33B, or a communication error between the CPU 40 and the electrostatic capacitance sensor IC33B, and notifies the video controller 42. The ascending flank threshold value is the initial value+30% and the falling signal flank threshold value is the initial value+20% because of providing hysteresis to prevent false operation by noise. In S111B, the CPU 40 detects that the detection member 351B has passed on the detection surface of the electrostatic capacitance sensor electrode 321B.

Then, in S112B and S113B, the CPU 40 detects timing when the detection member 352B reaches the detection surface of the electrostatic capacitance sensor electrode 321B. In S112B, the CPU 40 detects timing when the electrostatic capacitance between the electrode to be detected 362B on the detection member 352B and the electrostatic capacitance sensor electrode 321B changes to the ascending flank threshold value or more. In this embodiment, the ascending flank threshold value of the detection level is the initial value+30%. Timing when the detection level is the ascending flank threshold value or more is determined to be timing when the detection member 352B reaches the detection surface of the electrostatic capacitance sensor electrode 321B. When the CPU 40 determines in S112B that the detection level of the electrostatic capacitance sensor IC33B is the ascending flank threshold value or more, the CPU 40 proceeds to the process in S113B. When the CPU 40 determines in S112B that the detection level of the electrostatic capacitance sensor IC33B is less than the ascending flank threshold value, the CPU 40 detects an error in S123B. The processes in S123B and S124B are the same as the processes in S121B and S122B, and thus descriptions thereof will be omitted. In S113B, the CPU 40 stops the timer B at timing when the electrostatic capacitance between the electrode to be detected 361B on the detection member 352B and the electrostatic capacitance sensor electrode 321B changes to the ascending flank threshold value or more.

In S114B, the CPU 40 reads the value of the timer B. In S115B, the CPU 40 compares the timer B with the table T to check the values. As shown in FIG. 17C, the table T represents remaining amounts of toner (%) corresponding to time differences (msec). For example, in FIG. 17B, the time difference is 390 msec, and it can be detected from the table T that the remaining amount of toner is 60%. As described above, the CPU 40 checks a value between the values in the table against a value calculated by a linear interpolation based on the table T to determine the remaining amount of toner. In S116B, the CPU 40 notifies the video controller 42 of the main body of the remaining amount of toner (%) determined in S115B.

Rotating the detection member in the detection sequence of the remaining amount of toner has been described, but the remaining amount of toner can be detected if the detection member is rotated such as during an image forming operation. Before detection of the remaining amount of toner, the detection member may be rotated several times, and the detection of the remaining amount of toner may be started after the rotation state of the detection member is stabilized. Further, in this embodiment, the remaining amount of toner is calculated based on one measurement result (the value of the timer B in S114B), but the remaining amount of toner may be determined from an average value of a plurality of measurements to further increase the accuracy. The falling signal flank threshold value, the ascending flank threshold value, the value of the timer A, and the error determination time defined herein are examples in this configuration. These values are determined collectively in view of the placement of the detection members 351B and 352B, the rotational speed of the detection member, the circuit constant, and the detection level of the electrostatic capacitance sensor, and thus not limited to these.

In this embodiment, the sequence is exemplified of detecting the detection member 351B and then detecting the detection member 352B in the processes in S106B to S109B. However, the following method may be used. Three timings when the detection level detected by the electrostatic capacitance sensor IC33B changes to the ascending flank threshold value or more are detected. A time difference between the first timing and the second timing and a time difference between the second timing and the third timing are calculated. In this embodiment, a smaller value of the two time differences can be determined to be a time difference between the detection member 351B and the detection member 352B. The time difference is checked with the table T to determine the remaining amount of toner. This can simplify the sequence.

Also in this embodiment, the remaining amount of toner is determined based on the difference between the time when the electrostatic capacitance between the electrode to be detected 361B provided on the detection member 351B and the electrostatic capacitance sensor electrode 321B starts changing to the ascending flank threshold value or more and the time when the electrostatic capacitance between the electrode to be detected 362B provided on the detection member 352B and the electrostatic capacitance sensor electrode 321B starts changing to the ascending flank threshold value or more. However, the remaining amount of toner may be determined based on a difference between a time when the electrostatic capacitance between the electrode to be detected 361B provided on the detection member 351B and the electrostatic capacitance sensor electrode 321B starts changing to the falling signal flank threshold value or less and a time when the electrostatic capacitance between the electrode to be detected 362B provided on the detection member 352B starts changing to the falling signal flank threshold value or less. The remaining amount of toner may be determined based on a time between when the electrostatic capacitance between the electrode to be detected 361B and the electrostatic capacitance sensor electrode 321B starts changing to the ascending flank threshold value or more and when the electrostatic capacitance between the electrode to be detected 362B and the electrostatic capacitance sensor electrode 321B starts changing to the falling signal flank threshold value or less. As a result, a time when the detection member 352B finishes passing on the detection surface of the electrostatic capacitance sensor electrode 321B can be considered, thereby allowing the remaining amount of toner to be detected with higher accuracy.

Further, in this embodiment, the electrode to be detected 361B provided on the detection member 351B is placed near the tip of the detection member 351B in the circumferential direction. However, the electrode to be detected 361B is placed near the rotation axis 29B (on the side of the rotation axis) to allow the detection member 351B to be detected at regular intervals irrespective of the remaining amount of toner with flexibility of the detection member 351B. A difference from the time detected by the detection member 352B can be calculated to more accurately detect the amount of deflection of the detection member 352B, thereby allowing the remaining amount of toner to be detected with higher accuracy.

As such, the remaining amount of toner is determined based on the time difference between the timing when the detection member 351B reaches the detection surface of the electrostatic capacitance sensor electrode 321B and the timing when the detection member 352B reaches the detection surface of the electrostatic capacitance sensor electrode 321B. This allows the remaining amount of toner to be successively detected from a full state to an empty state of toner. Since the electrostatic capacitance changes with approach of the detection member, the electrostatic capacitance sensor can simultaneously reduce the detection time and perform an image forming operation. Further, the deflection of the detection member is stable according to the remaining amount of toner even during high speed rotation, thereby allowing the remaining amount of toner to be successively detected.

According to this embodiment, the remaining amount of toner can be successively detected from a full state to an empty state of toner, and the remaining amount of toner can be detected with high accuracy even during high speed operation of the agitation member.

Embodiment 5

In Embodiment 4, the detection member 35B1 has flexibility, and is flexed by resistance of the toner 28B. In this embodiment, an agitation rod 261B is provided, has high rigidity, and has a function of agitating the toner 28B. A configuration of an image forming apparatus in this embodiment is the same as the configuration described in Embodiment 4 except a process cartridge 5, and thus descriptions thereof will be omitted.

(Configuration of Process Cartridge)

Figure 19:
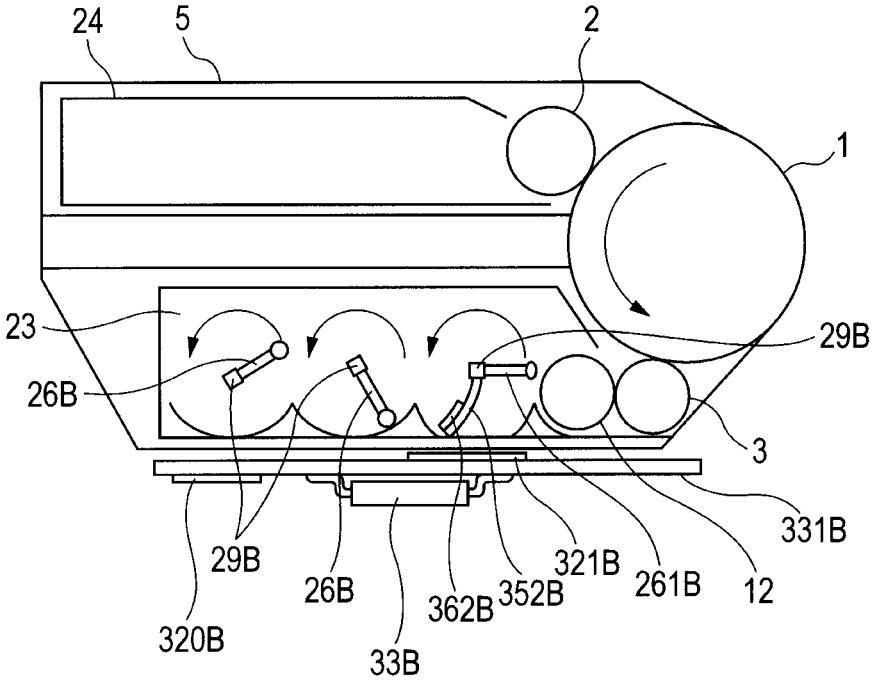
FIG. 19 is a sectional view of a developing unit and an electrostatic capacitance sensor board in Embodiments 5 and 7.

With reference to FIG. 19, the process cartridge in this embodiment will be described. FIG. 19 is a sectional view of the process cartridge and an electrostatic capacitance sensor board in this embodiment. A toner container 23 of the process cartridge 5 in this embodiment includes a toner (not shown) corresponding to each color, and the agitation rod 261B that feeds the toner to a toner supply roller 12. The agitation rod 261B rotates around the rotation axis 29B and agitates the toner. Another rotation axis 29B includes an agitation rod 261B and a detection member 352B for detecting a remaining amount of toner. The agitation rod 261B has high rigidity, and constantly rotates irrespective of resistance of the toner. The detection member 352B is placed 90° behind the agitation rod 261B in a rotational direction and has flexibility. The agitation rod 261B uses a conductive member. A conductive electrode to be detected 362B is provided near the tip of the detection member 352B in the circumferential direction.

An electrostatic capacitance sensor board 331B including an electrostatic capacitance sensor IC33B that detects the remaining amount of toner in the toner container 23 is provided near an outer wall of a developing unit in the circumferential direction of the agitation rod 261B and the detection member 352B. The electrostatic capacitance sensor electrode 321B is brought close to an exterior of the toner container 23 when the process cartridge 5 is mounted to the main body 101. In this state, the electrostatic capacitance sensor IC33B detects electrostatic capacitance generated by the agitation rod 261B or the electrode to be detected 362B provided in the developing unit. A circuit diagram in this embodiment is the same as in FIG. 15 described in Embodiment 1, and detailed descriptions thereof will be omitted.

Figure 18A:
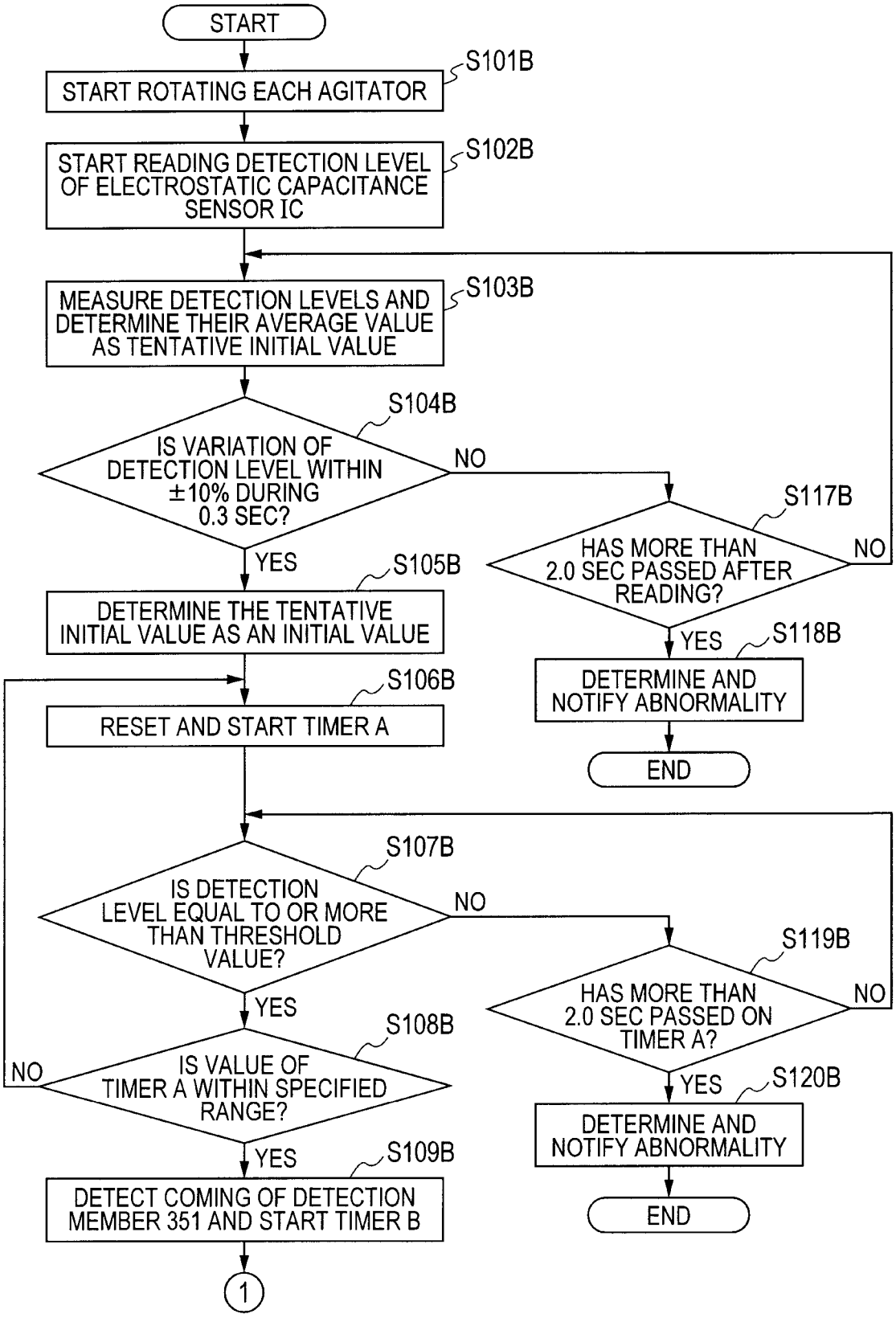
FIGS. 18A and 18B are flowcharts of detection of a remaining amount of toner in Embodiments 4 and 5.
Figure 18B:
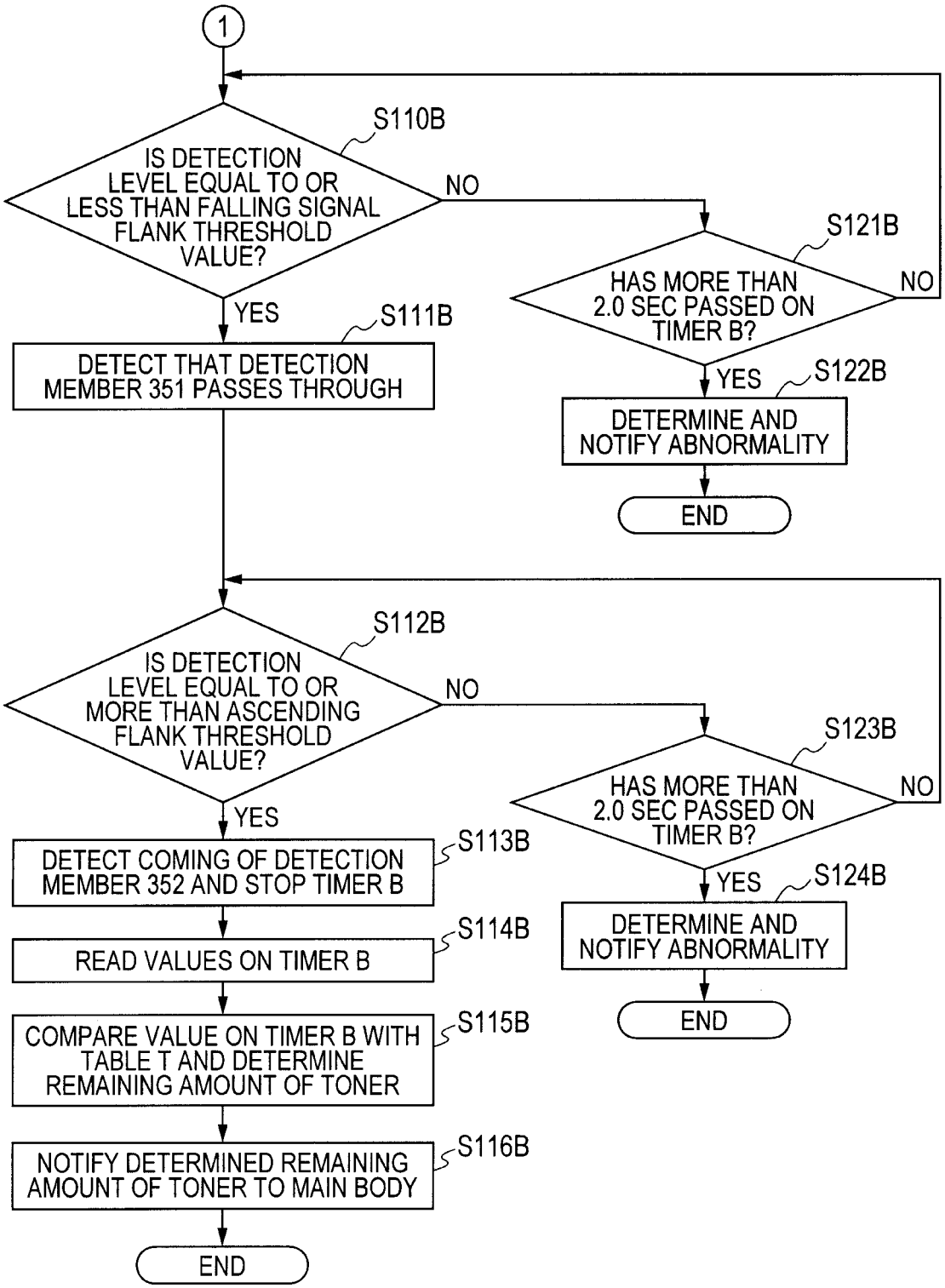

A flowchart and a detection characteristic are the same as in FIGS. 17A, 17B, 17C, 18A and 18B in Embodiment 4. The agitation rod 261B in this embodiment corresponds to the detection member 351B and the electrode to be detected 361B in Embodiment 4. Thus, for example, the detection member 351B in S109B in the flowchart in FIGS. 18A and 18B is read as the agitation rod 261B in this embodiment. The agitation rod 261B has high rigidity, and constantly rotates irrespective of resistance of the toner. Thus, the agitation rod 261B constantly rotates irrespective of the remaining amount of toner, and a time is detected by the electrostatic capacitance sensor IC33B always at regular intervals. Thus, a difference between time of detection of the agitation rod 261B and time of detection of the detection member 352B can be calculated to more accurately detect the amount of deflection of the detection member 352B, thereby allowing the remaining amount of toner to be detected with higher accuracy.

According to this embodiment, the remaining amount of toner can be successively detected from a full state to an empty state of toner, and the remaining amount of toner can be detected with high accuracy even during high-speed operation of the agitation member.

Embodiment 6

In Embodiment 4, the remaining amount of toner is detected by the time difference between the timings when the electrostatic capacitance sensor IC33B detects the two detection members. In contrast to this, in this embodiment, a change in electrostatic capacitance detected by an electrostatic capacitance sensor IC33B is detected to detect a remaining amount of toner. First, a color laser printer of this embodiment will be described. An image forming apparatus, a process cartridge, and a circuit diagram in this embodiment are the same as the configurations described in Embodiment 4 and illustrated in FIGS. 14A, 14B and 15, and detailed descriptions thereof will be omitted.

(Characteristic of Detection of Remaining Amount of Toner)

With reference to FIGS. 20A, 20B and 20C, a detection characteristic of the remaining amount of toner in this embodiment will be described. FIG. 20A is a characteristic graph representing a remaining amount of toner (%) and a difference between detection levels of a detection member 351B and a detection member 352B detected by the electrostatic capacitance sensor IC33B. The detection level difference decreases with increasing remaining amount of toner, and the detection level difference increases with decreasing remaining amount of toner. Thus, the detection level difference can be calculated to detect the remaining amount of toner. FIG. 20B illustrates waveform data when the remaining amount of toner is 10%. In this embodiment, the electrostatic capacitance sensor IC33B calculates an average value of detection levels of detection of an electrode to be detected 361B provided on the detection member 351B and an electrode to be detected 362B provided on the detection member 352B. The remaining amount of toner is determined using a difference between average values of the calculated detection levels (that is, detection level difference). In FIG. 20B, it is found that an average value A of detection levels of the detection member 351B is 195, an average value B of detection levels of the detection member 352B is 210, and a difference between the average values of the detection levels, that is, a detection level difference is 15. FIG. 20C is a table N representing correspondence between the detection level difference and the remaining amount of toner. A remaining amount of toner between the values in the table is calculated using a known linear interpolation. Since the calculated detection level value is a value in this embodiment, the calculated value of the detection level difference changes depending on conditions. The same applies to values in the table for determining the remaining amount of toner.

(Flowchart of Detection of Remaining Amount of Toner)

Figure 21A:
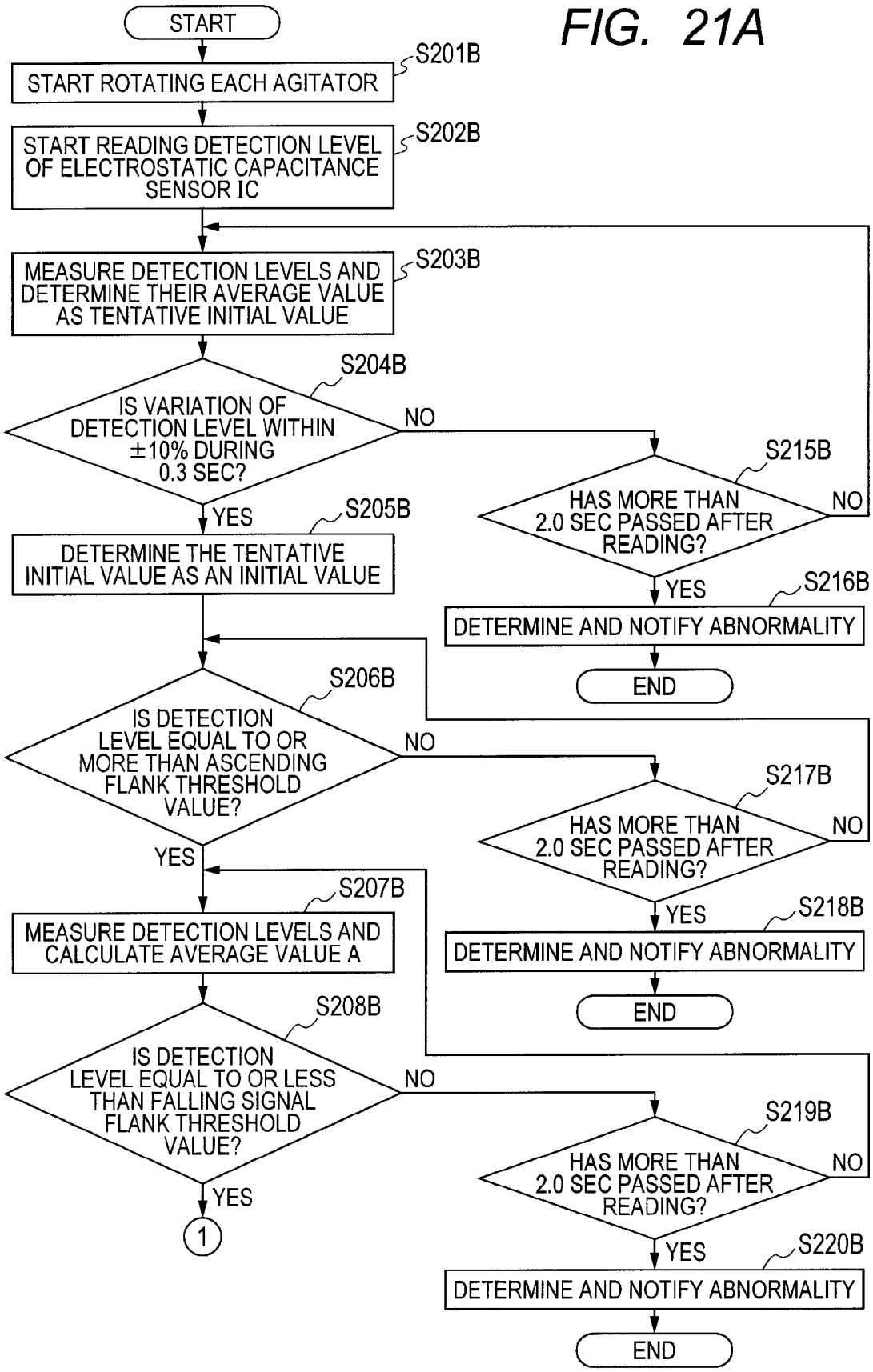
FIGS. 21A and 21B are flowcharts of detection of a remaining amount of toner in Embodiments 6 and 7.
Figure 21B:
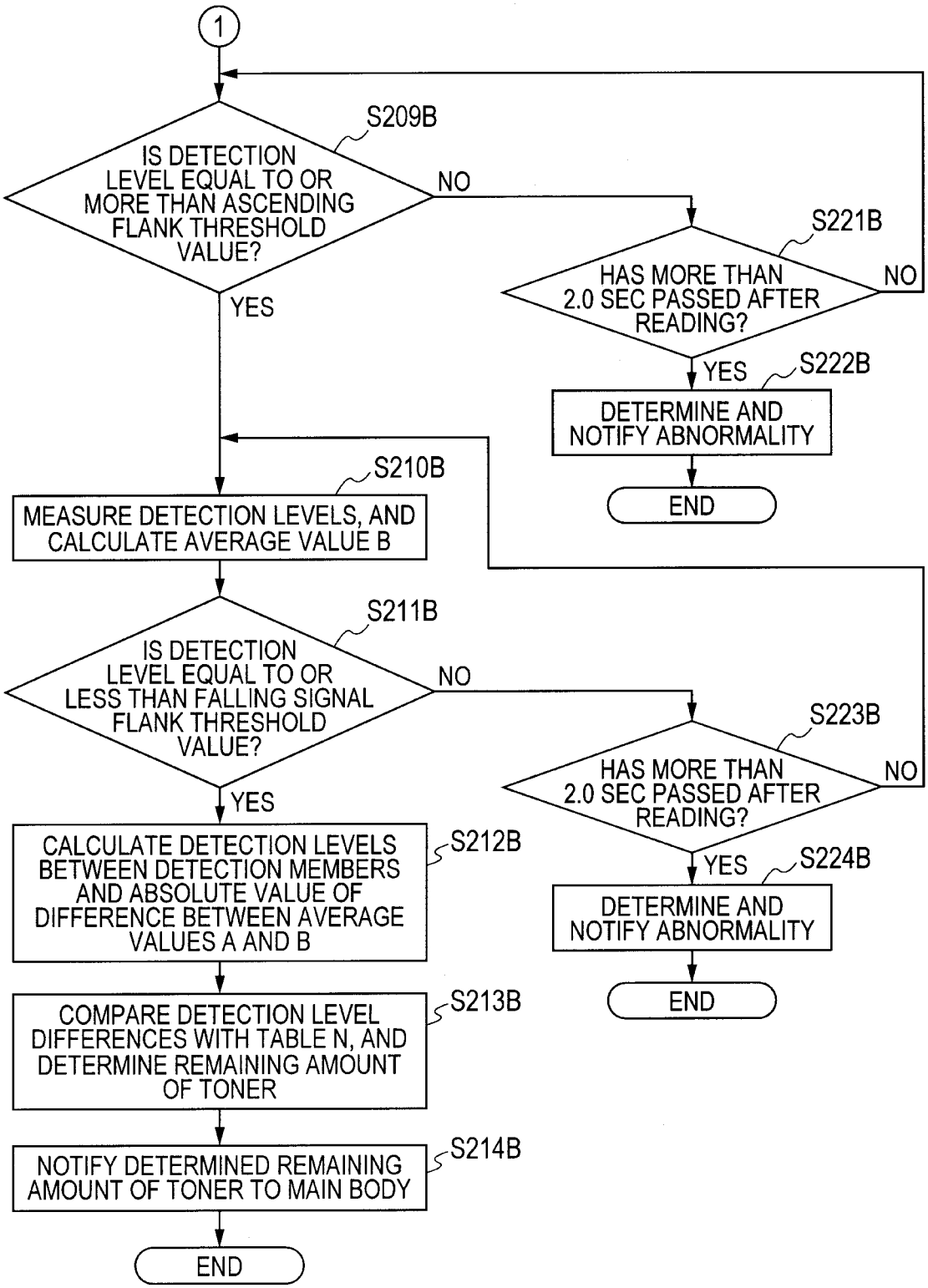

With reference to the flowchart in FIGS. 21A and 21B, a sequence of detecting the remaining amount of toner in this embodiment will be described. S201B to S205B, S215B and S216B are the same as S101B to S105B, S117B and S118B in FIGS. 6A and 6B in Embodiment 4, and thus descriptions thereof will be omitted. In S206, the CPU 40 detects the detection member 351B or the detection member 352B. In S206B, the CPU 40 detects timing when a detection level of electrostatic capacitance between the electrode to be detected 361B on the detection member 351B or the electrode to be detected 362B on the detection member 352B and the electrostatic capacitance sensor electrode 321B starts changing to an ascending flank threshold value or more. In this embodiment, the ascending flank threshold value of the detection level is an initial value determined in S205B+30%. Timing when the detection level is the ascending flank threshold value or more is determined to be timing when the detection member 351B or the detection member 352B reaches a detection surface of the electrostatic capacitance sensor electrode 321B. When the CPU 40 determines in S206B that the detection level of the electrostatic capacitance sensor IC33B is the ascending flank threshold value or more, the CPU 40 proceeds to the process in S207B. Meanwhile, when the CPU 40 determines in S206B that the detection level of the electrostatic capacitance sensor IC33B is less than the ascending flank threshold value, the CPU 40 determines an error in S217B. The processes in S217B and S218B are the same as the processes in S215B and S216B, and thus descriptions thereof will be omitted.

Next, in S207B and S208B, the CPU 40 calculates the average value of the detection levels of the detection member 351B or the detection member 352B and detects passage of the detection member 351B or the detection member 352B. In S207B, the CPU 40 measures the monitored detection level of the electrostatic capacitance sensor IC33B at a plurality of points, and stored in, for example, a memory (not shown). At this time, the CPU 40 stores the number of pieces of obtained measurement data in the memory, and calculates an average value A from the plurality of pieces of measurement data and the number of pieces of measurement data. In S208B, the CPU 40 detects timing when the detection level of the electrostatic capacitance between the electrode to be detected 361B on the detection member 351B or the electrode to be detected 362B on the detection member 352B and the electrostatic capacitance sensor electrode 321B changes to the falling signal flank threshold value or less. In this embodiment, the falling signal flank threshold value of the detection level of the electrostatic capacitance sensor IC33B is the initial value determined in S205B+20%. The CPU 40 determines that timing when the detection level of the electrostatic capacitance sensor IC33B is the falling signal flank threshold value or less is timing when the detection member 351B or the detection member 352B passes on the detection surface of the electrostatic capacitance sensor electrode 321B. When the CPU 40 determines in S208B that the detection level of the electrostatic capacitance sensor IC33B is the falling signal flank threshold value or less, monitoring is finished, the average value A is determined, and the CPU 40 proceeds to the process in S209B. When the CPU 40 determines in S208B that the detection level of the electrostatic capacitance sensor IC33B is not the falling signal flank threshold value or less, the CPU 40 determines an error in S219B. The processes in S219B and S220B are the same as the processes in S215B and S216B, and thus descriptions thereof will be omitted. Settings of the ascending flank threshold value and the falling signal flank threshold value are the same as in Embodiment 4, and a description thereof will be omitted.

Next, in S209B, the detection member 352B or the detection member 351B is detected. If the detection member 351B is detected in S206B, the detection member 352B is detected in S209B, and if the detection member 352B is detected in S206B, the detection member 351B is detected in S209B. In S209B, the CPU 40 determines whether the detection level of the electrostatic capacitance between the electrode to be detected 362B on the detection member 352B or the electrode to be detected 361B on the detection member 351B and the electrostatic capacitance sensor electrode 321B is the ascending flank threshold value or more. In this embodiment, the ascending flank threshold value of the detection level is the initial value determined in S205B+30%. The CPU 40 determines that timing when the detection level exceeds the ascending flank threshold value is timing when the detection member 352B or the detection member 351B reaches the detection surface of the electrostatic capacitance sensor electrode 321B. When the CPU 40 determines in S209B that the detection level of the electrostatic capacitance sensor IC33B is the ascending flank threshold value or more, the CPU 40 proceeds to the process in S210B. Meanwhile, when the CPU 40 determines in S209B that the detection level of the electrostatic capacitance sensor IC33B is not the ascending flank threshold value or more, the CPU 40 proceeds to the process in S221B. The processes in S221B and S222B are the same as the processes in S215B and S216B, and thus descriptions thereof will be omitted.

Next, in S210B and S211B, the CPU 40B calculates the average value of the detection levels of the detection member 352B or the detection member 351B and detects passage of the detection member 352B or the detection member 352B. In S210B, the CPU 40 measures the monitored detection level of the electrostatic capacitance sensor IC33B at a plurality of points, and stored in, for example, a memory (not shown). At this time, the CPU 40 stores the number of obtained measurement data in the memory, and calculates an average value B from the plurality of pieces of measurement data and the number of pieces of measurement data. In S211B, the CPU 40 determines whether the detection level of the electrostatic capacitance between the electrode to be detected 362B on the detection member 352B or the electrode to be detected 361B on the detection member 351B and the electrostatic capacitance sensor electrode 321B is the falling signal flank threshold value or less. In this embodiment, the falling signal flank threshold value of the detection level of the electrostatic capacitance sensor IC33B is the initial value+20%. Timing when the detection level is lower than the falling signal flank threshold value is determined to be timing when the detection member 352B or the detection member 351B passes on the detection surface of the electrostatic capacitance sensor electrode 321B. When the CPU 40 determines in S211B that the detection level of the electrostatic capacitance sensor IC33B is the falling signal flank threshold value or less, monitoring of the detection level of the electrostatic capacitance sensor IC33B is finished, the average value B is determined, and the CPU 40 proceeds to the process in S212B. When the CPU 40 determines in S211B that the detection level of the electrostatic capacitance sensor IC33B is not the falling signal flank threshold value or less, the CPU 40 determines an error in S223B. The processes in S223B and S224B are the same as the processes in S215B and S216B, and thus descriptions thereof will be omitted. Settings of the ascending flank threshold value and the falling signal flank threshold value are the same as in Embodiment 4, and a description thereof will be omitted.

In S212B, the CPU 40 calculates a detection level difference between the detection members from the average value A calculated in S207B and the average value B calculated in S210B. In this embodiment, an absolute value of a difference between the average value A and the average value B is calculated. For example, in FIG. 20B, the average value A−the average value B=195-210, and the absolute value is 15. In S213B, the CPU 40 checks the detection level difference calculated in S212B against a table N. The table N represents remaining amounts of toner corresponding to detection level differences, for example, as shown in FIG. 20C. The CPU 40 checks the value against the table N to determine the remaining amount of toner. For example, in FIG. 20B, the absolute value of the detection level difference is 15, and it is found from the table N in FIG. 20C that the remaining amount of toner is 10%. As described above, a value between the values in the table N is calculated using a known linear interpolation. In S214B, the CPU 40 notifies the video controller 42 of the determined remaining amount of toner.

As such, in this embodiment, the remaining amount of toner is determined based on the difference between the detection level of the electrostatic capacitance between the electrode to be detected 361B provided on the detection member 351B and the electrostatic capacitance sensor electrode 321B and the detection level of the electrostatic capacitance between the electrode to be detected 362B provided on the detection member 352B and the electrostatic capacitance sensor electrode 321B. This allows the remaining amount of toner to be successively detected from a full state to an empty state of toner. Since the detection level of the electrostatic capacitance changes with approach of the detection member, the electrostatic capacitance sensor IC can simultaneously reduce the detection time and perform an image forming operation. Further, the deflection of the detection member is stable according to the remaining amount of toner even during high speed rotation, thereby allowing the remaining amount of toner to be successively detected.

According to this embodiment, the remaining amount of toner can be successively detected from a full state to an empty state of toner, and the remaining amount of toner can be detected with high accuracy even during high speed operation of the agitation member.

Embodiment 7

In Embodiment 6, the detection member 351B has flexibility, and is flexed by resistance of a toner. In this embodiment, an agitation rod 261B is provided, the agitation rod 261B corresponds to the detection member 351B, has high rigidity, and has a function of agitating toner. A configuration of an image forming apparatus in this embodiment is the same as the configuration described in Embodiment 4 except a process cartridge 5, and thus a description thereof will be omitted. In this embodiment, the process cartridge in FIG. 19 in Embodiment 5 is used, and a sequence of detection of a remaining amount of toner is as in a flowchart in FIGS. 21A and 21B. In the description of the flowchart in FIGS. 21A and 21B, the detection member 351B is read as the agitation rod 261B. A detection characteristic is the same as in FIGS. 20A to 20C described in Embodiment 6. The agitation rod 261B has high rigidity, and constantly rotates irrespective of resistance of the toner. Thus, the agitation rod 261B constantly rotates irrespective of the remaining amount of toner, and a detection level detected by an electrostatic capacitance sensor IC33B is constant. Thus, a difference between detection levels of detection by the agitation rod 261B and the detection member 352B can be calculated to more accurately detect the detection level difference by deflection of the detection member 352B, thereby allowing the remaining amount of toner to be detected with higher accuracy.

According to this embodiment, the remaining amount of toner can be successively detected from a full state to an empty state of toner, and the remaining amount of toner can be detected with high accuracy even during high speed operation of the agitation member.

Other Embodiments

In Embodiments 4 to 7, the description is made that the table is referred to in one time detection for simplicity of understanding. However, it can be expected that averaging a plurality of pieces of data and then referring to each table further increases detection accuracy.

In Embodiments 4 to 7, the configuration in which the two detection members are placed in the developing unit is described. However, placing three or more detection members allows the remaining amount of toner to be detected with higher accuracy.

In Embodiments 4 to 7, the example of the developing unit having the integral configuration is taken. However, the present invention can be applied to a supply toner container including a developing roller and a toner container separately provided, by providing an electrode to be detected and a detection member in the toner container.

Also according to the other embodiments, the remaining amount of toner can be successively detected from a full state to an empty state of toner, and the remaining amount of toner can be detected with high accuracy even during high speed operation of the agitation member.

The present invention is not limited to the above embodiments, but various changes or modifications may be made without departing from the spirit and the scope of the present invention. Thus, claims are appended for making the scope of the present invention public.

Reference Signs List

321 electrostatic capacitance sensor electrode
33 electrostatic capacitance sensor
34 agitator
351 detection member
361 electrode to be detected
401 one-chip microcomputer (CPU)

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-084508, filed Apr. 6, 2011, and Japanese Patent Application No. 2011-093147, filed Apr. 19, 2011, which are hereby incorporated by reference herein in their entirety.

The invention claimed is:

1. An image forming apparatus comprising:

a developing unit detachably attached to the image forming apparatus, the developing unit containing a developer;

a first member that includes a first electrode and is rotatable around a rotation axis in the developing unit;

a second member that moves around the rotation axis in the developing unit, wherein when the second member rotates, the first member temporarily stops;

a second electrode provided on an exterior of the developing unit;

an output section that detects an electrostatic capacitance between the first electrode and the second electrode, and outputs data on the detected electrostatic capacitance; and a determining section that determines an amount of developer in the developing unit based on the data output from the output section.

2. The image forming apparatus according to claim 1, wherein the first member follows rotational movement of the second member until the first member freely falls by its own weight.

3. The image forming apparatus according to claim 1, wherein the second member has a function of agitating the developer in the developing unit.

4. The image forming apparatus according to claim 1, wherein the first electrode is provided near a tip of the first member in a circumferential direction.

5. The image forming apparatus according to claim 1, wherein the output section includes a setting section that sets an amplification factor of the data, and an amplification unit that amplifies the data according to the amplification factor set by the setting section.

6. The image forming apparatus according to claim 5, wherein the output section changes the amplification factor of the data according to a remaining amount of the developer.

7. The image forming apparatus according to claim 5, wherein the output section changes the amplification factor of the data when rotation of the first member stops.

8. An image forming apparatus comprising:

a developing unit detachably attached to the image forming apparatus, the developing unit containing a developer;

a first member that includes a first electrode and moves around a rotation axis in the developing unit;

a second member that includes a second electrode and is provided on the rotation axis of the first member with a predetermined angle with respect to the first member;

a third electrode provided on an exterior of the developing unit;

an output section that detects electrostatic capacitance between the first electrode and the third electrode or between the second electrode and the third electrode, and outputs data on the detected electrostatic capacitance; and a determining section that determines an amount of developer in the developing unit based on the data output from the output section, wherein the determining section determines the amount of developer based on a difference between a time when the output section detects electrostatic capacitance between the first electrode and the third electrode and a time when the output section detects electrostatic capacitance between the second electrode and the third electrode.

9. The image forming apparatus according to claim 8, wherein the first member and the second member have flexibility, and wherein the second member has a greater amount of deflection than the first member.

10. The image forming apparatus according to claim 9, wherein the first electrode is provided at a tip of the first member in a circumferential direction perpendicular to the rotation axis, and wherein the second electrode is provided at a tip of the second member in the circumferential direction.

11. The image forming apparatus according to claim 9, wherein the first electrode is provided on a side of the rotation axis of the first member in a circumferential direction perpendicular to the rotation axis, and wherein the second electrode is provided at a tip of the second member in the circumferential direction.

12. The image forming apparatus according to claim 8, wherein the second member has flexibility, and the second electrode is provided at a tip of the second member in a circumferential direction perpendicular to the rotation axis, and the first member comprises the first electrode, has higher rigidity than the second member, and has a function of agitating the developer.

13. An image forming apparatus comprising:

a developing unit detachably attached to the image forming apparatus, the developing unit containing a developer;

a first member that includes a first electrode and moves around a rotation axis in the developing unit;

a second member that includes a second electrode and is provided on the rotation axis of the first member with a predetermined angle with respect to the first member;

a third electrode provided on an exterior of the developing unit;

an output section that detects electrostatic capacitance between the first electrode and the third electrode or between the second electrode and the third electrode, and outputs data on the detected electrostatic capacitance; and a determining section that determines an amount of developer in the developing unit based on the data output from the output section, wherein the determining section determines the amount of developer based on a difference between data on electrostatic capacitance between the first electrode and the third electrode output from the output section and data on electrostatic capacitance between the second electrode and the third electrode output from the output section.

14. The image forming apparatus according to claim 13, wherein the first member and the second member have flexibility, and wherein the second member has a greater amount of deflection than the first member.

15. The image forming apparatus according to claim 14, wherein the first electrode is provided at a tip of the first member in a circumferential direction perpendicular to the rotation axis, and wherein the second electrode is provided at a tip of the second member in the circumferential direction.

16. The image forming apparatus according to claim 14, wherein the first electrode is provided on a side of the rotation axis of the first member in a circumferential direction perpendicular to the rotation axis, and wherein the second electrode is provided at a tip of the second member in the circumferential direction.

17. The image forming apparatus according to claim 13, wherein the second member has flexibility, and the second electrode is provided at a tip of the second member in a circumferential direction perpendicular to the rotation axis, and wherein the first member comprises the first electrode, has higher rigidity than the second member, and has a function of agitating the developer.

* * * * *